US010953662B2

(12) United States Patent
Muramatsu

(10) Patent No.: US 10,953,662 B2
(45) Date of Patent: Mar. 23, 2021

(54) INKJET PRINTING DEVICE AND PRINT DEFECT DETECTION METHOD

(71) Applicant: SCREEN HOLDINGS CO., LTD., Kyoto (JP)

(72) Inventor: Asuka Muramatsu, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/708,092

(22) Filed: Dec. 9, 2019

(65) Prior Publication Data

US 2020/0180326 A1 Jun. 11, 2020

(30) Foreign Application Priority Data

Dec. 10, 2018 (JP) ..... JP2018-230726

(51) Int. Cl.

| | |
|---|---|
| ***B41J 2/21*** | (2006.01) |
| ***B41J 2/165*** | (2006.01) |
| ***B41J 2/045*** | (2006.01) |
| ***B41J 11/42*** | (2006.01) |
| ***B41J 29/393*** | (2006.01) |

(52) U.S. Cl.

CPC ..... *B41J 2/2142* (2013.01); *B41J 2/0451* (2013.01); *B41J 2/04541* (2013.01); *B41J 2/16579* (2013.01); *B41J 2/2139* (2013.01); *B41J 11/42* (2013.01); *B41J 29/393* (2013.01)

(58) Field of Classification Search

CPC .. B41J 2/0451; B41J 2/04541; B41J 2/16579; B41J 2/16585; B41J 2/2139; B41J 2/2142; B41J 2/2146; B41J 11/42; B41J 29/393

See application file for complete search history.

(56) References Cited

U.S. PATENT DOCUMENTS

| | | | | |
|---|---|---|---|---|
| 5,552,810 | A | 9/1996 | Matsuo | |
| 2006/0115127 | A1* | 6/2006 | Hatayama | G06K 9/036 382/112 |
| 2012/0050378 | A1 | 3/2012 | Kido | |
| 2012/0154477 | A1* | 6/2012 | Yamazaki | B41J 2/2146 347/19 |
| 2014/0292888 | A1* | 10/2014 | Terada | B41J 2/04505 347/19 |

FOREIGN PATENT DOCUMENTS

| | | | |
|---|---|---|---|
| JP | 06-166247 | A | 6/1994 |
| JP | 2012-051135 | A | 3/2012 |

* cited by examiner

*Primary Examiner* — Anh T Vo

(74) *Attorney, Agent, or Firm* — McDermott Will & Emery LLP

(57) ABSTRACT

The present application discloses an inkjet printing device in which a nozzle that caused a print defect, such as an ejection failure, is reliably identified by a simple process even when an end of a test pattern is not recorded. In a configuration example of the inkjet printing device, a test pattern TPat to be printed for identifying a recording head nozzle that caused a print defect consists of an ejection failure detection pattern DPat and a position detection pattern PPat. The position detection pattern PPat consists of a position mark PM4 and pairs of position marks (PM1 and PM1; PM2 and PM2; and PM3 and PM3) symmetrically arranged with respect to the position mark PM4 in a sheet width direction. Each position mark consists of three linear patterns having the same length and disposed at equal intervals. Moreover, the position detection pattern PPat is configured such that linear pattern length decreases with increasing distance from a center position mark.

17 Claims, 14 Drawing Sheets

INKJET PRINTING DEVICE AND PRINT DEFECT DETECTION METHOD

CROSS-REFERENCE TO RELATED APPLICATIONS

This application claims priority to Japanese Patent Application No. 2018-230726, filed Dec. 10, 2018, entitled "Inkjet Printing Device and Print Defect Detection Method", the contents of which are incorporated herein by reference.

BACKGROUND OF THE INVENTION

1. Field of the Invention

The present invention relates to inkjet printing devices with recording heads including a number of nozzles through which ink is ejected, more specifically to a technology for detecting a print defect, such as an ejection failure or faulty gradation, in such an inkjet printing device and identifying a nozzle corresponding to the detected print defect.

2. Description of the Related Art

In an inkjet printing device for recording an image on a recording medium, such as recording paper or film, by ejecting ink through nozzles, ink might not be ejected through the nozzles due to ink solidification resulting from the device not used for a long period, due to external contamination by foreign matter, due to bubble formation, or for other reasons, or ink droplets ejected from the nozzles might land in wrong spots. Such an ink ejection failure causes an image recorded on a recording medium to have missing dots corresponding to a nozzle having failed to eject ink (hereinafter, such a nozzle will be referred to as an "ejection-failed nozzle"). In such a case, an operation is performed so as to recover the function of the ejection-failed nozzle (e.g., by unclogging the nozzle), or a substitute ejection is performed such that ink droplets that should be ejected from the ejection-failed nozzle are ejected by another nozzle.

In the case of an inkjet device with recording heads having a number of nozzles as recording elements arranged in a direction corresponding to the width of a recording medium with a view to achieving high-speed image recording or printing on the recording medium, to prevent missing dots due to an ejection failure as described above, it is necessary to detect an ejection failure and identify an ejection-failed nozzle in the recording head. In this regard, in a conventional inkjet printing device, the recording heads record test patterns on a recording medium, and ejection failure detection and ejection-failed nozzle identification are performed on the basis of a test pattern image recorded on the recording medium.

In relation to the inkjet printing device and the print defect detection method disclosed herein, Japanese Laid-Open Patent Publication No. 2012-51135 describes an inkjet recording device with recording heads, each including nozzles disposed beyond the width of a recording medium (in a direction crossing a direction in which the recording medium is fed). This inkjet recording device records test patterns on the recording medium by means of the recording heads and reads the test patterns by means of a scanner portion, thereby obtaining image data based on which it is detected whether there is any image flaw caused by an ejection failure. In the inkjet recording device, each test pattern includes at least two reference marks arranged along the width of the recording medium so as to provide positional references between the recording medium and the recording head. Upon detection of an image flaw caused by an ejection failure, reference marks are detected, and the position of an ejection-failed nozzle is detected on the basis of the position of the image flaw in the image data. Such an inkjet recording device can identify an ejection-failed nozzle even when an end of a test pattern is not recorded on a recording medium (see paragraphs 0017 and 0018).

Furthermore, Japanese Laid-Open Patent Publication No. H06-166247 describes a method for performing shading correction in an inkjet recording device with recording heads, each including a plurality of recording elements (in ejection orifices). In this inkjet recording device, an uneven density detection pattern is printed using the recording elements, and a recording element position detection pattern is printed using at least one of the recording elements in relation to the uneven density detection pattern. Density data is obtained for each pattern by an image sensor reading the pattern. The density data for the uneven density detection pattern is made to correspond to each recording element on the basis of the density data for the recording element position detection pattern (see paragraphs 0016 and 0046 to 0057).

In the inkjet recording device described in Japanese Laid-Open Patent Publication No. 2012-51135, the position of the ejection-failed nozzle is determined on the basis of a reference mark (or both the reference mark and position marks) in a test pattern recorded on a recording medium (see paragraphs 0156, 0157, and 0173), and therefore, the reference mark needs to be detected from the recoded test pattern. The reference mark, as with the position marks described in the sane publication, is rectangular (see paragraph 0091 and FIG. 4). To detect the reference mark from the recorded test pattern, image correlation processing is performed on the test pattern in a similar manner to that for the position marks (see paragraphs 0122, 0123, and 0165). Accordingly, it takes long time to identify the ejection-failed nozzle. Moreover, in the configuration described in the publication, the reference mark includes different colors (see paragraphs 0097 and 0098), and an image of the reference mark cannot be recorded in a single color.

In the inkjet recording device described in Japanese Laid-Open Patent Publication No. H06-166247, the density data for the uneven density detection pattern is made to correspond to each ejection orifice on the basis of the position detection pattern, which is formed of ink ejected from only specific ejection orifices or recording elements (see paragraph 0049), and therefore, such a correspondence processing can be performed in a relatively short period of time. Moreover, the publication describes a position detection pattern formed by five specific ejection orifices, and this position detection pattern allows the density data for the uneven density detection pattern to correspond to each of the five ejection orifices even when any one of the five ejection orifices fails to eject ink (see paragraph 0050). However, when ends of the uneven density detection pattern and the ejection position detection pattern are missing in a density data image obtained by reading these patterns from recording paper, the density data for the uneven density detection pattern cannot always be made to correctly correspond to the ejection orifices. Moreover, when the image includes some lines caused by dust or other foreign matter, and such a line is mistaken for the position detection pattern, the density data for the uneven density detection pattern might not be made to correctly correspond to the ejection orifices.

SUMMARY OF THE INVENTION

Therefore, it is desired for an inkjet printing device to be configured such that a nozzle that caused a print defect, such as an ejection failure or faulty gradation, can be reliably identified by a simple process even when an end of a test pattern is not recorded.

To achieve the above objective, one aspect of the present invention is directed to an inkjet printing device having an inspection mode in which to detect a print defect. The device includes:

a recording head configured to eject ink onto a recording medium;

a feeding mechanism configured to move the recording medium in a predetermined feeding direction relative to the recording head;

a control portion configured to control the recording head and the feeding mechanism to record an image on the recording medium; and an imaging portion configured to capture an image recorded on the recording medium, wherein, the recording head includes a plurality of nozzles arranged in a direction perpendicular to the feeding direction, the control portion in the inspection mode controls the recording head and the feeding mechanism to record a test pattern image on the recording medium, the test pattern image including a print defect detection pattern for detecting a print defect in an image to be recorded on the recording medium by the recording head and a position detection pattern for detecting a position of the print defect detected based on the print defect detection pattern, the control portion in the inspection mode causes the imaging portion to capture the test pattern image recorded on the recording medium and thereby obtain a target test pattern image, the control portion in the inspection mode detects a print defect from the target test pattern image and identifies a defective nozzle based on the detected print defect, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles, and when the test pattern image is recorded on the recording medium, an image of each linear pattern in the position detection pattern is recorded with ink ejected from a nozzle corresponding to the linear pattern.

Another aspect of the present invention is directed to a print defect detection method for detecting a print defect in forming an image on a recording medium by an inkjet printing device ejecting ink onto the recording medium through a plurality of nozzles arranged in a recording head in a direction perpendicular to a predetermined feeding direction while moving the recording medium in the feeding direction relative to the recording head. The method includes:

an image formation step of recording a test pattern image on the recording medium, the test pattern image including a print defect detection pattern for detecting a print defect in an image to be recorded on the recording medium by the recording head and a position detection pattern for detecting a position of the print defect detected based on the print defect detection pattern;

an imaging step of obtaining a target test pattern image by capturing the test pattern image recorded on the recording medium by the image formation step; and a defect detection step of detecting a print defect from the target test pattern image and identifies a defective nozzle based on the detected print defect, wherein, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles, and when the test pattern image is recorded on the recording medium, an image of each linear pattern in the position detection pattern is recorded with ink ejected from a nozzle corresponding to the linear pattern.

These and other objects, features, aspects and advantages of the invention will become more apparent from the following detailed description of the invention when taken in conjunction with the accompanying drawings.

DESCRIPTION OF THE EMBODIMENTS

Hereinafter, an embodiment of the present invention will be described with reference to the accompanying drawings.

1. Overall Configuration

Figure 1:
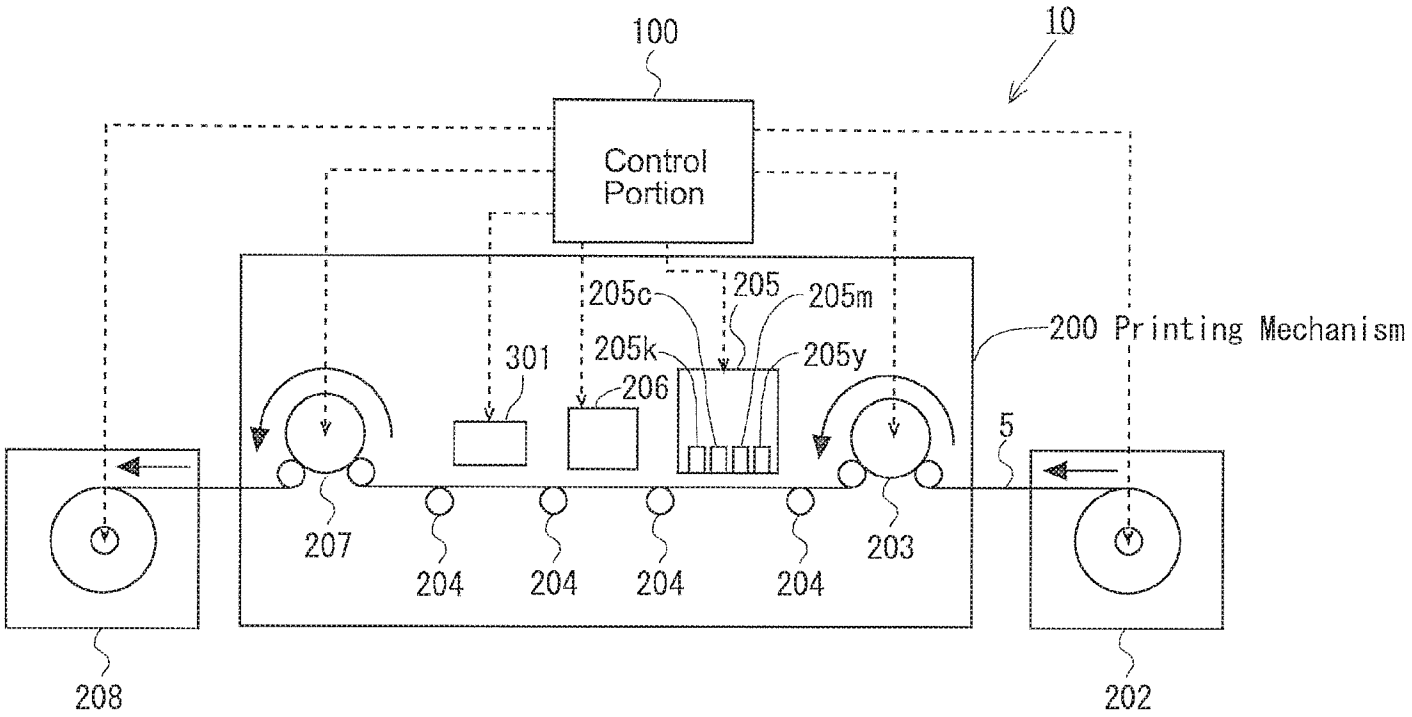
FIG. 1 is a schematic diagram illustrating the configuration of an inkjet printing device according to an embodiment of the present invention.

FIG. 1 is a schematic diagram illustrating the configuration of an inkjet printing device 10 according to an embodiment of the present invention. The printing device 10 includes a sheet feeding portion 202 for supplying a printing sheet (also referred to below simply as a "sheet") 5, which is a recording medium, a first drive roller 203 for feeding the printing sheet 5 into a printing mechanism 200, a plurality of support rollers 204 for feeding the sheet 5 through the printing mechanism 200, a recording portion 205 for ejecting ink and thereby performing printing on the sheet 5, a drying portion 206 for drying the sheet 5 after the printing, a second drive roller 207 for ejecting the sheet 5 from the printing mechanism 200, and a sheet winding portion 208 for rolling up the sheet 5 after the printing. The first drive roller 203, the support rollers 204, and the second drive roller 207 are included in a feeding mechanism for conveying the sheet 5. Note that the recording portion 205 includes first, second, third, and fourth recording head arrays 205*y*, 205*m*, 205*c*, and 205*k* respectively ejecting yellow (Y), magenta (M), cyan (C), and black (K) ink. Moreover, the printing mechanism 200 includes an imaging portion 301, which is, for example, a CCD or CMOS image sensor. The imaging portion 301 captures an image of the printed sheet 5, and sends the resulting data to a control portion 100. Note that the inkjet printing device 10 is operated in normal mode for printing an image represented by manuscript data or print data received via a network 3, and also in inspection mode for detecting print defects (details will be described later).

2. Configuration of the Control Portion

Figure 2:
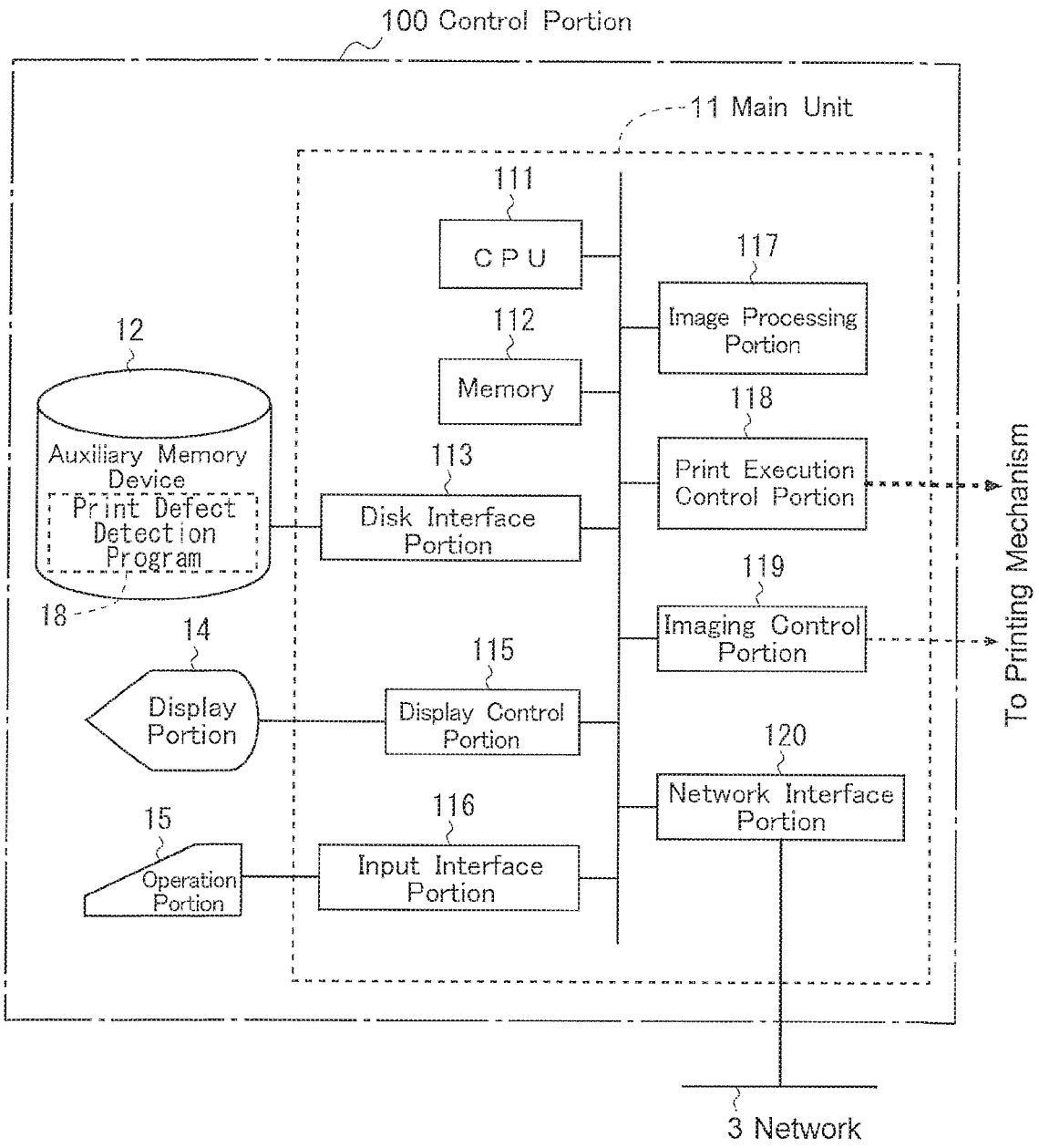
FIG. 2 is a block diagram illustrating the hardware configuration of a control portion in the embodiment.

FIG. 2 is a block diagram illustrating the hardware configuration of the control portion 100 in the inkjet printing device 10. The control portion 100 includes a main unit 11, an auxiliary memory device 12, a display portion 14, and an operation portion 15. The main unit 11 includes a CPU 111, memory 112, a disk interface portion 113, a display control portion 115, an input interface portion 116, an image processing portion 117, a print execution control portion 118, an imaging control portion 119, and a network interface portion 120. The CPU 111, the memory 112, the disk interface portion 113, the display control portion 115, the input interface portion 116, the image processing portion 117, the print execution control portion 118, the imaging control portion 119, and the network interface portion 120 are connected to one another via a system bus. The disk interface portion 113 is connected to the auxiliary memory device 12. The display control portion 115 is connected to the display portion 14. The input interface portion 116 is connected to the operation portion 15, including a keyboard, a mouse, etc. The network interface portion 120 is connected to the network 3, and the control portion 100 is connected to a host device, etc., via the network 3. The auxiliary memory device 12 is a magnetic disk or suchlike. The display portion 14 is a liquid crystal display or suchlike. The display portion 14 is used for displaying information desired by an operator. The operation portion 15 is used by the operator in order to input an instruction to the inkjet printing device 10.

The auxiliary memory device 12 has stored therein a print control program for generating print data from manuscript data and causing the printing mechanism 200 to print an image represented by the print data in normal mode, as well as a print defect detection program 18 for detecting print defects such as an ejection failure and faulty gradation in inspection mode. The CPU 111 reads out the print control program or the print defect detection program 16 from the auxiliary memory device 12 and executes the program on the memory 112, thereby realizing various functions of the inkjet printing device 10. The memory 112 includes random access memory (RAM) and read only memory (ROM). The memory 112 functions as a work area in which the CPU 111 executes the program.

The image processing portion 117 generates print data in bitmap format by rasterizing manuscript data written in a page description language, under control of the CPU 111 executing the print control program. The print execution control portion 118 functions as an interface for the CPU 111 executing the print control program to control various portions of the printing mechanism 200. The imaging control portion 119 functions as an interface for the CPU 111 executing the print control program to control the imaging portion 301 to capture an image of a test pattern printed in inspection mode.

3. Configuration of the Recording Portion (A) of FIG. 3 is a schematic diagram illustrating the configuration of the recording portion 205 in the present embodiment, and (B) of FIG. 3 is a schematic diagram illustrating the configuration of inkjet heads (also referred to below as "recording heads") 210 included in the recording portion 205.

Figure 3:
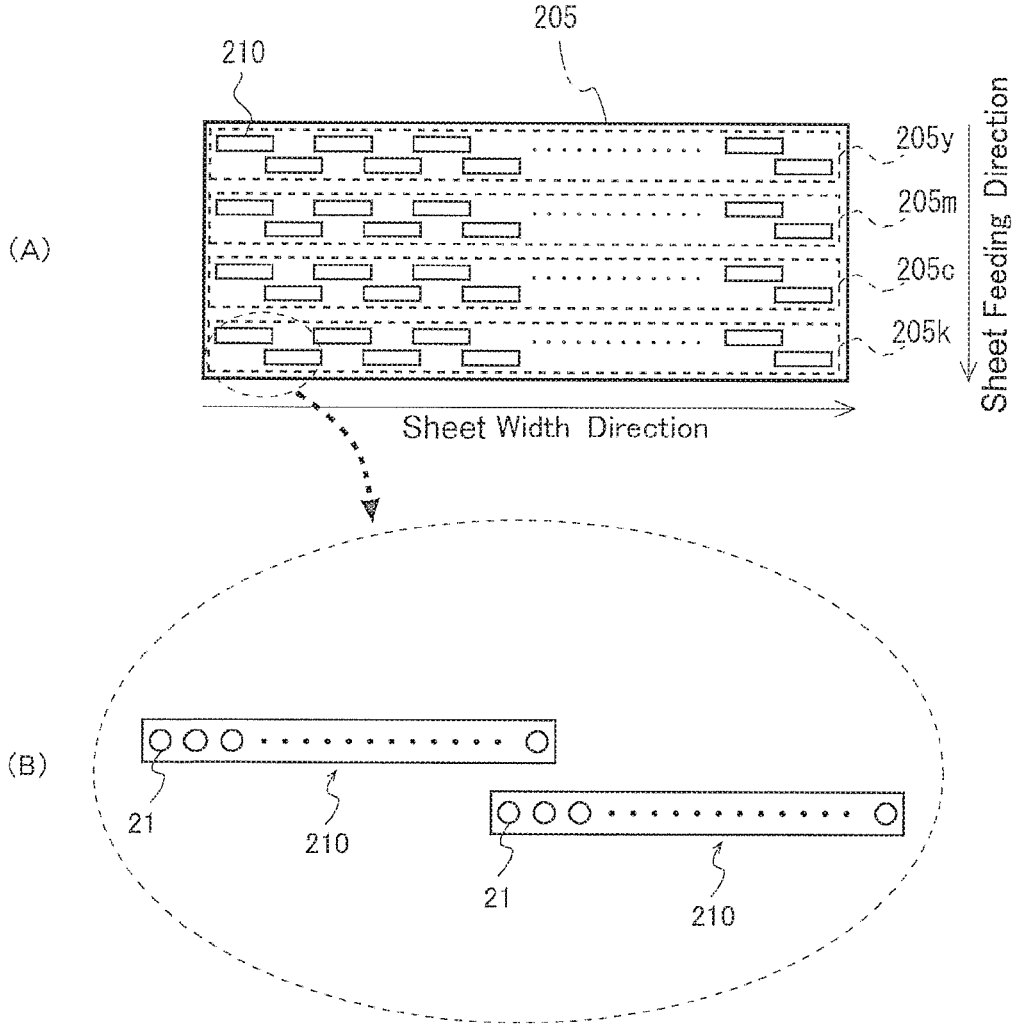
FIG. 3 consists of a schematic diagram (A) illustrating the configuration of a recording portion in the embodiment and a schematic diagram (B) illustrating the configuration of a recording head in the embodiment.

As shown in (A) of FIG. 3, the recording portion 205 includes of cyan (C), magenta (M), yellow (Y), and black (K) recording head arrays (or inkjet head arrays) 205*y*, 205*m*, 205*c*, and 205*k* arranged in a direction in which the sheet 5 is fed. Each recording head array 205*x* (where x=y, m, c, or k) consists of n recording heads 210 arranged in two rows extending in a direction (referred to below as a "sheet width direction") perpendicular to the sheet feeding direction in a staggered configuration. The n recording heads 210 are arranged across the width of the sheet 5.

As shown in (B) of FIG. 3, each recording head 210 includes a large number of nozzles (or ink ejecting portions) 21 arranged in the sheet width direction. Each recording head 210 of the yellow recording head array 205*y* ejects yellow ink through the nozzles 21. Each recording head 210 of the magenta recording head array 205*m* ejects magenta ink through the nozzles 21. Each recording head 210 of the cyan recording head array 205*c* ejects cyan ink through the nozzles 21. Each recording head 210 of the black recording head array 205*k* ejects black ink through the nozzles 21.

Figure 4:
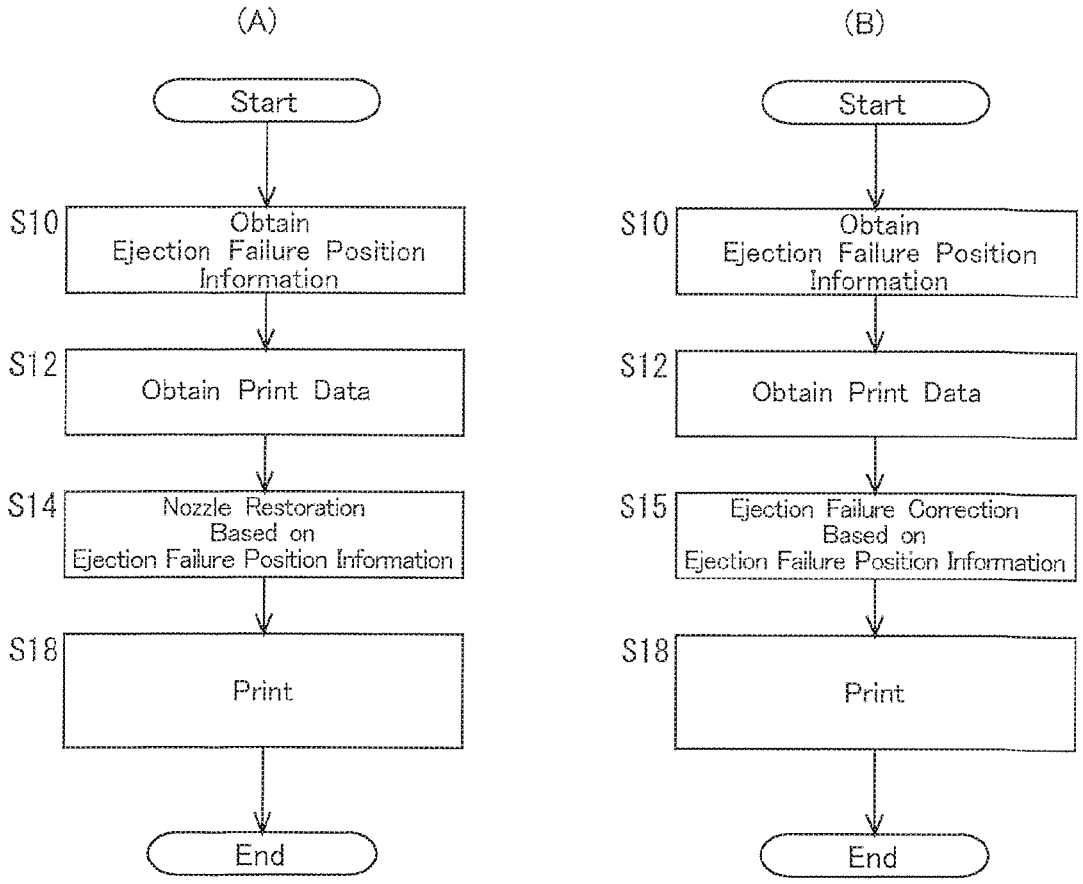
FIG. 4 consists of a flowchart (A) showing an example of a print process in the embodiment and a flowchart (B) showing another example of the print process.

4. Print Process (A) of FIG. 4 is a flowchart showing an example of a print process in the present embodiment. The inkjet printing device according to the present embodiment is operated in either normal or inspection mode. In normal mode, the image processing portion 117 rasterizes manuscript data and thereby obtain print data, and an image represented by the print data is printed on the sheet 5 in accordance with the procedure shown in (A) of FIG. 4. Specifically, in normal mode, the CPU 111 in the control portion 100 is operated as below in accordance with the print control program.

First, ejection failure position detection information is obtained (step S10). The ejection failure position detection information is generated in inspection mode by a print defect detection process to be described later, and prestored to the memory 112 (details will be described later with reference to FIG. 5 and other figures). Next, print data is obtained in bitmap format, as described earlier, (step S12). Note that in the case where the printing device 10 externally receives print data in bitmap format, the rasterizing by the image processing portion 117 is dispensable. Subsequently, the recording portion 205 of the printing mechanism 200 and other elements are controlled such that nozzle restoration is performed on a nozzle group including at least an ejection-failed nozzle (i.e., a nozzle with an ejection failure) identified by the ejection failure position detection information (step S14). Here, the nozzle restoration is intended for preventing increase in ink viscosity, removing bubbles, dust, etc., from a clogged nozzle, or cleaning a head surface. Specific examples of the nozzle restoration include flushing for causing ink to be ejected vigorously from a nozzle, suction purge for cleaning a nozzle surface by suction, and wiping for cleaning a head surface and thereby removing foreign matter from the head surface. After such nozzle restoration, various portions of the printing mechanism 200 are controlled on the basis of the print data such that the recording portion 205 ejects ink onto the sheet 5 that is being fed (step S18). As a result, the image represented by the print data is recorded on the sheet 5.

(B) of FIG. 4 is a flowchart showing another example of the print process in the present embodiment. In this print process, the inkjet printing device according to the present embodiment obtains print data in a manner as described above and prints an image represented by the print data on the sheet 5 in normal mode in accordance with the procedure shown in (B) of FIG. 4. Specifically, in normal mode, the CPU 111 in the control portion 100 is operated as below in accordance with the print control program.

First, ejection failure position detection information is obtained (step S10), as in the print process in (A) of FIG. 4. Then, print data is obtained in bitmap format (step S12). Next, the print data is subjected to ejection failure correction based on the ejection failure position detection information (step S15). Here, the ejection failure correction is intended to, when the recording head 210 includes an ejection-failed nozzle, correct the print data as density data, such that a missing dot caused in an image to be printed on the sheet 5 due to the ejection-failed nozzle, i.e., failed ink droplet ejection, can be compensated for by an ink droplet from another nozzle. For example, to compensate for such a missing dot, the amount of ink to be ejected from a nozzle adjacent to the ejection-failed nozzle is increased. After such ejection failure correction, various portions of the printing mechanism 200 are controlled based on the corrected print data, and the recording portion 205 ejects ink onto the sheet 5 that is being fed (step S18). As a result, the image represented by the print data is recorded on the sheet 5. As can be appreciated from the above, in the print process in (B) of FIG. 4, ejection failure correction, rather than nozzle restoration such as flushing, is performed based on the ejection failure position detection information (step S15).

5. Printing Defect Detection Process

Figure 5:
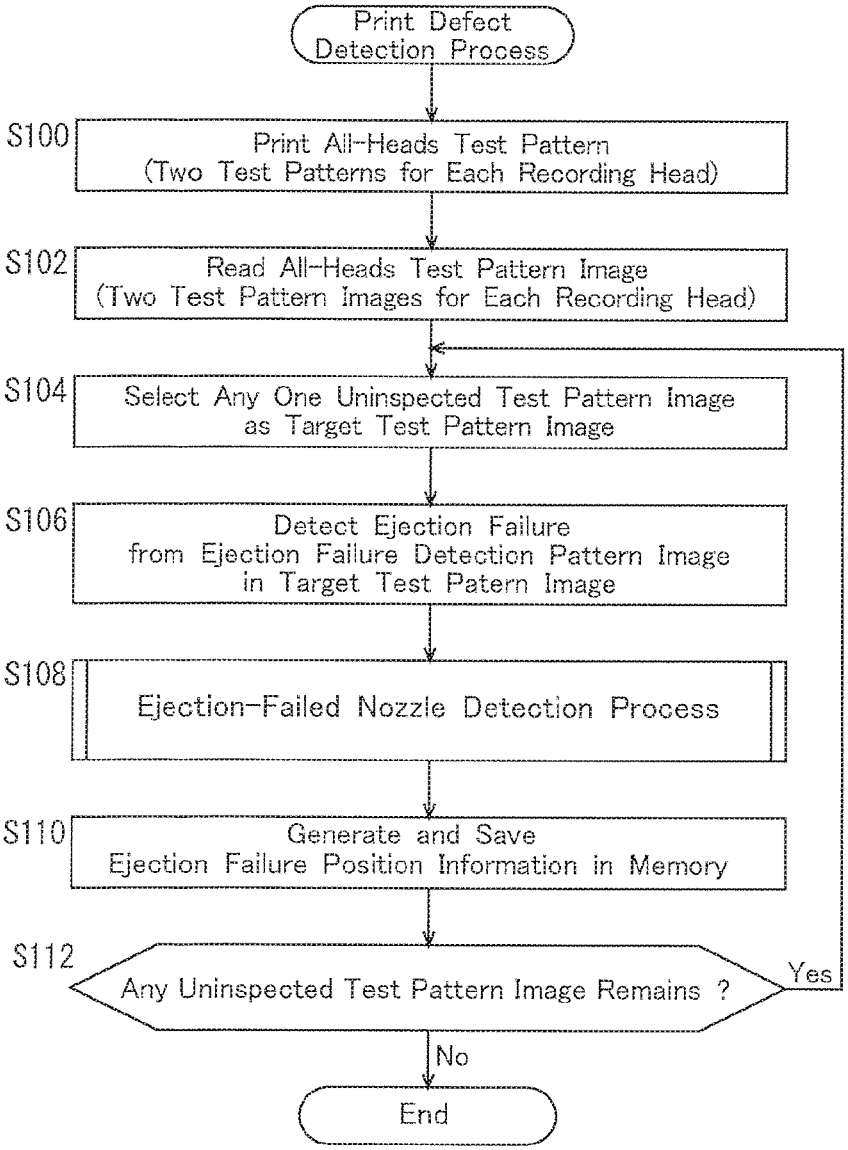
FIG. 5 is a flowchart showing a print defect detection process in the embodiment.

The inkjet printing device according to the present embodiment performs a print defect detection process in inspection mode in order to generate ejection failure position detection information as described above. FIG. 5 is a flowchart showing the procedure of the print defect detection process. In the present embodiment, when in inspection mode, the CPU 111 in the control portion 100 is operated as shown in FIG. 5, in accordance with the print defect detection program 16.

Figure 6:
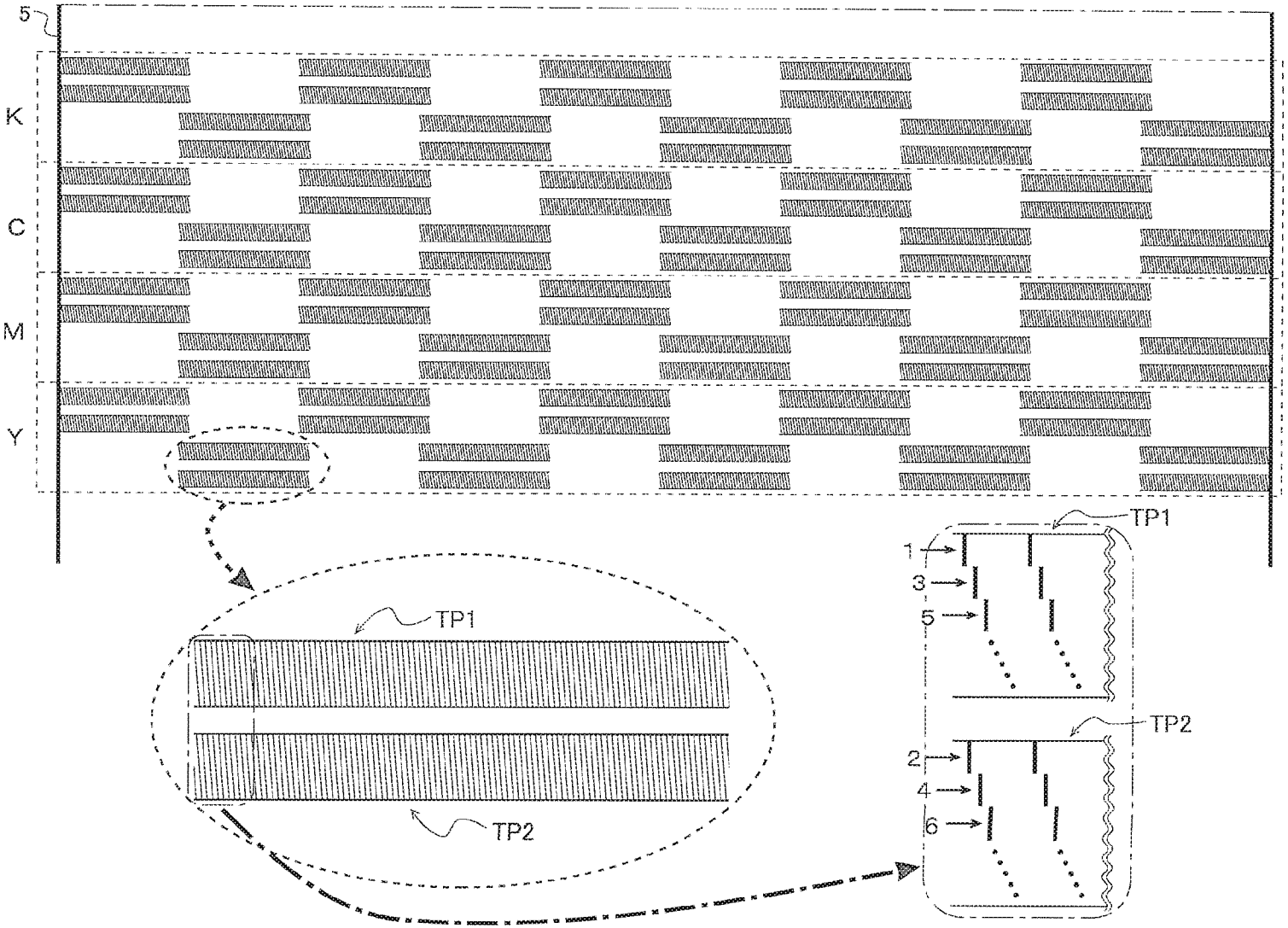
FIG. 6 is a diagram for describing a test pattern in the embodiment.

Specifically, the CPU 111 initially controls various portions of the printing mechanism 200 such that the recording portion 205 ejects ink onto a sheet 5 that is being fed, and an image of a test pattern for all of the recording heads 210 of the recording portion 205 (referred to below as an "all-heads test pattern") is recorded on the sheet 5 (step S100). FIG. 6 is a diagram illustrating an example of an all-heads test pattern image recorded on a sheet by a conventional inkjet printing device. A similar all-heads test pattern is basically used for inspection mode in the present embodiment. The difference between the all-heads test pattern shown in FIG. 6 and the all-heads test pattern in the present embodiment will be described later.

Figure 7:
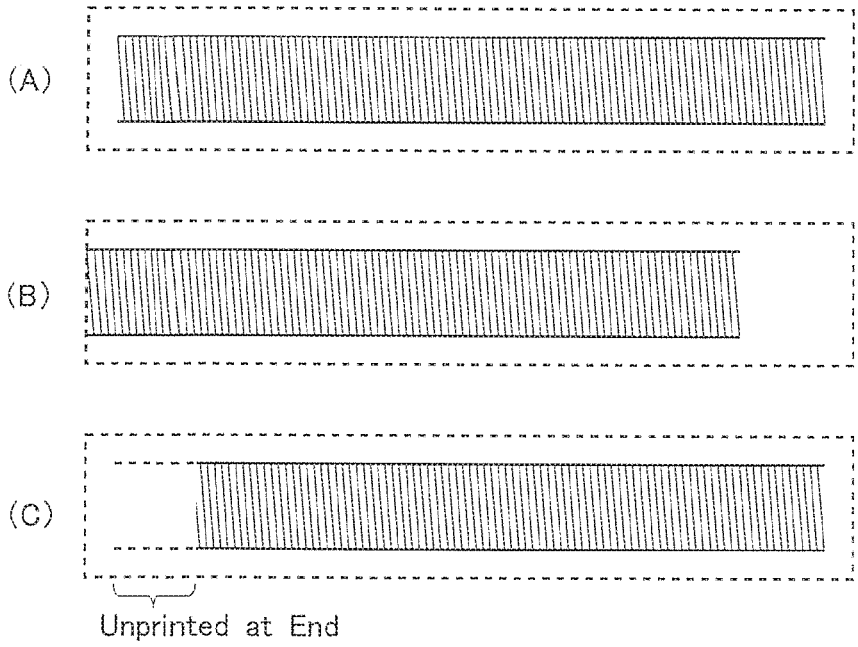
FIG. 7 is a diagram for describing a problem related to a test pattern image of an inkjet printing device.
Figure 8:
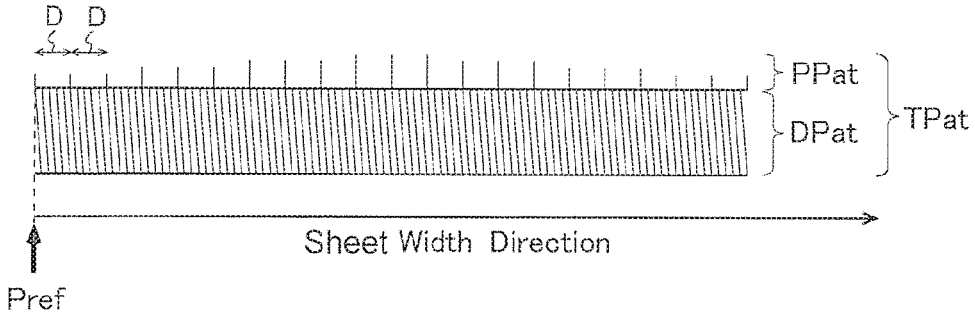
FIG. 8 is a diagram illustrating an example of the test pattern in the embodiment.
Figure 9:
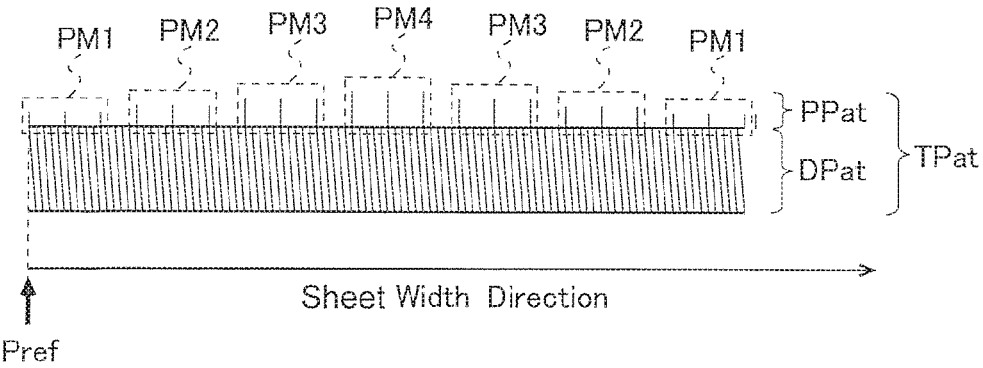
FIG. 9 is a diagram for describing a position detection pattern included in the test pattern in the embodiment.

The conventional test pattern and the test pattern in the present embodiment will be described below with reference to FIGS. 7 to 9 along with FIG. 6. FIG. 7 is a diagram for describing a problem related to the test pattern image of the conventional inkjet printing device. FIG. 8 is a diagram illustrating an example of the test pattern in the present embodiment. FIG. 9 is a diagram for describing a position detection pattern included in the test pattern in the present embodiment.

In the all-heads test pattern image shown in FIG. 6, each recording head 210 corresponds to first and second patterns TP1 and TP2 parallel to each other. Of these two patterns, the first pattern TP1 consists of a large number of short lines recorded with ink ejected from odd-numbered nozzles of the corresponding recording head 210. The second pattern TP2 consists of a large number of short lines recorded with ink ejected from even-numbered nozzles of the corresponding recording head 210. The reason why the test pattern includes two patterns TP1 and TP2 for each recording head 210, as described above, is to increase reading accuracy for the imaging portion 301 to capture an image of the test pattern recorded on the sheet 5. Depending on the resolution of the imaging portion 301 (when considered that the resolution is sufficiently high), each recording head 210 may correspond to only one pattern recorded with ink ejected from all nozzles of the recording head 210, instead of the two patterns TP1 and TP2.

In the all-heads test pattern image shown in FIG. 6, for each of the colors Y, M, C, and K, n unit patterns, each of which consists of two patterns TP1 and TP2 and corresponds to a recording head 210 included in the recording portion 205 shown in (A) of FIG. 3, are arranged in two rows extending in the sheet width direction in a staggered configuration (in the example shown in FIG. 6, n=10). In the print defect detection process, for each recording head 210, two patterns TP1 and TP2 corresponding to the recording head 210 are clipped out one by one as test pattern images from the all-heads test pattern image, and detection of an ejection failure (due to nozzle clogging), which is an example of the print defect, is performed sequentially on each of the clipped-out patterns TPk (where k is 1 or 2). Each test pattern image is clipped out with margins, as shown in (A) of FIG. 7. However, for example, when the sheet 5 skews, or when detection of reference marks (not shown) for use in clipping out the test pattern image is failed, the test pattern might be deviated to the left or right (in the sheet width direction) beyond an area from which the test pattern image is to be clipped out, as shown in (B) of FIG. 7. Moreover, an end of the test pattern might not be printed on the sheet 5 (i.e., the end is missing in the print) due to a chipped edge of the recording head 210, as shown in (C) of FIG. 7. In such cases, no ejection failure can be detected for the end of the recording head 210 from the clipped-out test pattern image.

A pattern TPat represented by a test pattern image to be clipped out in the present embodiment (such a pattern will be referred to below as a "unit test pattern" or simply as a "test pattern") consists of a test pattern DPat similar to the conventional pattern TP1 or TP2 (FIG. 6) for use in ejection failure detection (such a test pattern will be referred to below as an "ejection failure detection pattern") and a position detection pattern PPat consisting of a plurality of linear patterns arranged in the sheet width direction, as shown in FIG. 8. Moreover, the test pattern TPat is configured such that the ejection failure detection pattern DPat and the position detection pattern PPat positionally correspond to each other in the sheet width direction. First and second ends of the ejection failure detection pattern DPat are respectively aligned with first and second ends of the position detection pattern PPat in the sheet width direction.

The linear patterns that constitute the position detection pattern PPat extend in the direction in which the sheet 5 is fed, and the linear patterns are arranged at equal intervals in the sheet width direction. The interval between adjacent linear patterns is predetermined to be D. Each of the linear patterns corresponds to a specific nozzle 21 of the recording head 210 and has a width of one dot to be recorded on the sheet 5 only with ink ejected from the corresponding nozzle 21. Moreover, as shown in FIG. 9, the linear patterns that constitute the position detection pattern PPat are divided into a plurality of groups which each consist of three adjacent linear patterns having the same length (in the example shown in FIG. 9, seven linear pattern groups). Each linear pattern group constitutes a position mark indicating a position in the test pattern TPat in the sheet width direction (position marks including linear patterns of the same length are denoted herein by the same reference characters). Moreover, as shown in FIG. 9, the position detection pattern PPat includes one or more position mark pairs, each consisting of two position marks constituted by linear patterns groups having the same length. The position detection pattern PPat also includes another position mark constituted by a linear pattern group (consisting of three linear patterns) different in length from any of the linear pattern groups in the one or more position mark pairs, which are disposed symmetrically with respect to this position mark in the sheet width direction. That is, the position mark is positioned in the middle, and the position mark pairs disposed with the position mark positioned in the middle. In the example shown in FIG. 9, three position mark pairs (PM1 and PM1; PM2 and PM2; and PM3 and PM3) are arranged symmetrically with respect to one position mark PM4 positioned in the middle. Note that as for the position detection pattern PPat shown in FIG. 9, the interval between two adjacent position marks is equal to the interval D between the three linear patterns that constitute one position mark (FIG. 8), but the position marks PM1 to PM4 may be arranged at intervals different from the interval D.

In the present embodiment, the position marks in the position detection pattern PPat are classified into several types depending on the length of the linear pattern group included therein, and the length of the linear pattern group included in each type of the position mark is predetermined. Accordingly, the type of each position mark in the position detection pattern PPat can be determined by the length of the linear pattern group included in the position mark. Note that in the following, the position mark consisting of the shortest linear pattern group among the four types of position marks shown in FIG. 9 will be referred to as the "first position mark" and denoted by the symbol "PM1", the position mark consisting of the second shortest linear pattern group will be referred to as the "second position mark" and denoted by the symbol "PM2", the position mark consisting of the third shortest linear pattern group will be referred to as the "third position mark" and denoted by the symbol "PM3", and the position mark consisting of the longest linear pattern group will be referred to as the "fourth position mark" and denoted by the symbol "PM4". In the example shown in FIG. 9, the three position mark pairs (PM1 and PM1; PM2 and PM2; and PM3 and PM3) are arranged in descending order of linear pattern length from the position mark M4 in the middle.

Referring back to FIG. 5, after the all-heads test pattern image is printed, the CPU 111 causes the imaging portion 310 to read the all-heads test pattern image (step S102). The all-heads test pattern image that has been read includes pairs of test pattern images corresponding to respective recording heads (see FIG. 6).

Next, the CPU 111 selects any one test pattern image from the all-heads test pattern image that has been read, as a target test pattern image (TPat). Specifically, the target test pattern image is clipped out of the all-heads test pattern image (step S104). Thereafter, a pattern that corresponds to an ejection failure is detected from an ejection failure detection pattern image (DPat) in the target test pattern image (TPat). Specifically, a part of the ejection failure detection pattern image that corresponds to an image flaw caused by the ejection failure (the part appearing as a missing dot) is detected (step S106).

Figure 10:
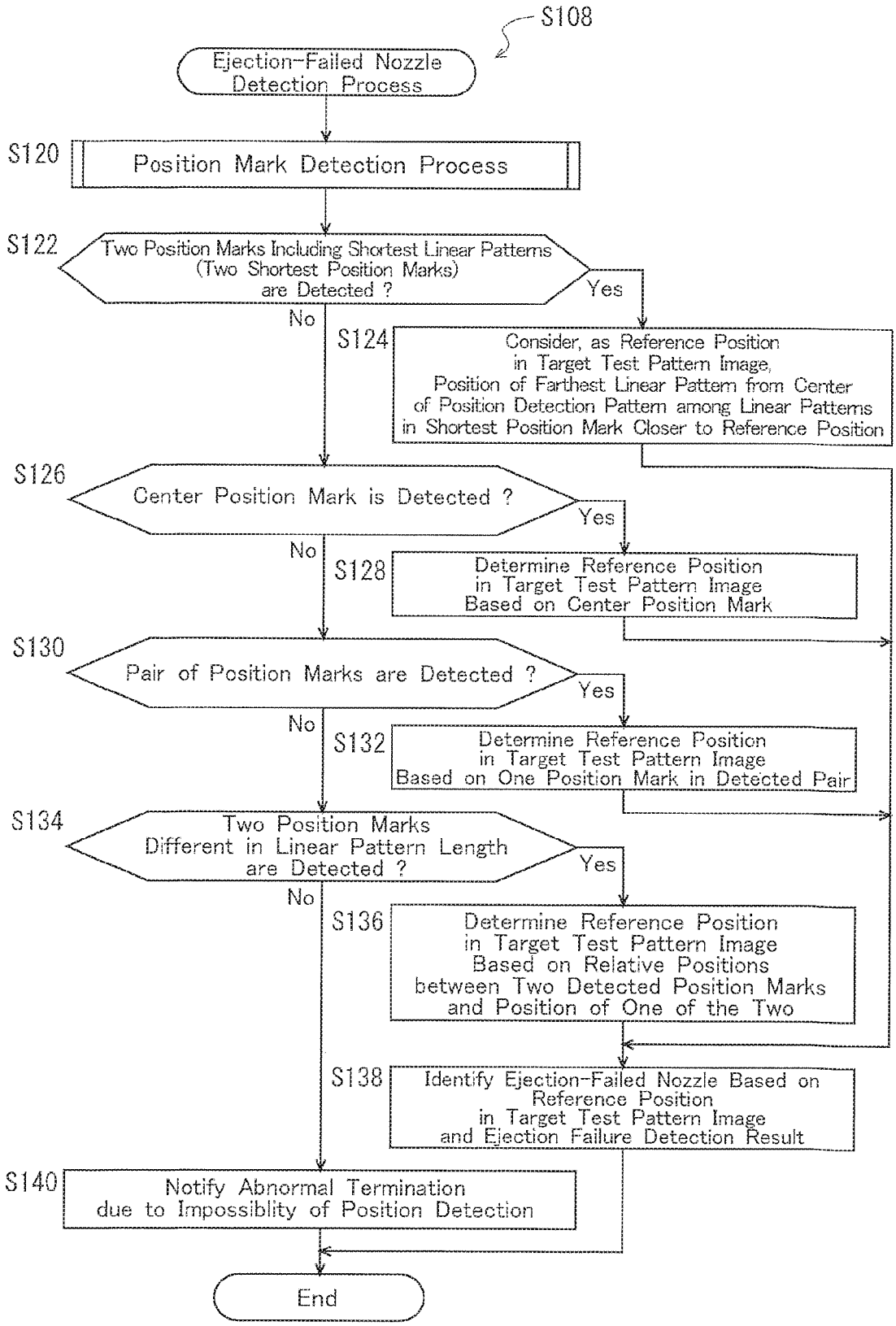
FIG. 10 is a flowchart showing the details of an ejection-failed nozzle detection process included in the print defect detection process.

Next, the CPU 111 executes an ejection-failed nozzle detection process based on the result of the ejection failure detection (step S108). FIG. 10 is a flowchart showing the procedure of the ejection-failed nozzle detection process. In the ejection-failed nozzle detection process, the CPU 111 is operated as below.

Figure 11:
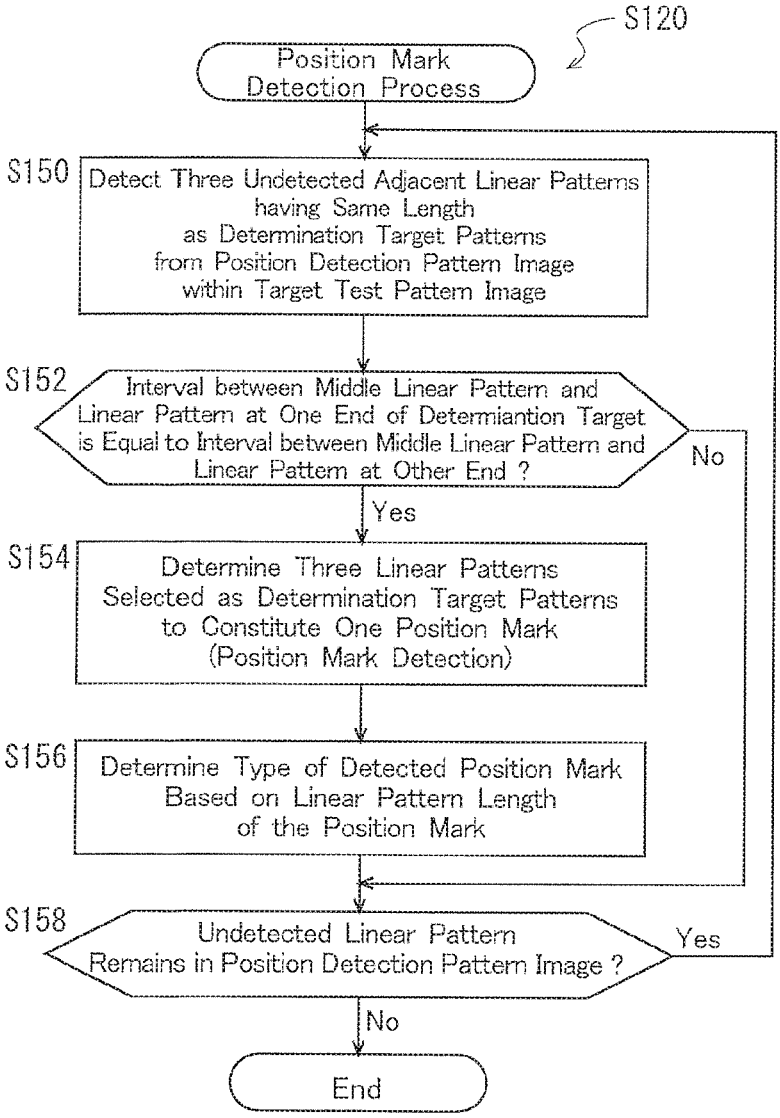
FIG. 11 is a flowchart showing the details of a position mark detection process included in the ejection-failed nozzle detection process.

First, the CPU 111 executes a position mark detection process shown in FIG. 11 (step S120). In the position mark detection process, three adjacent linear patterns having the same length are detected as determination target patterns from undetected linear patterns in a position detection pattern image (PPat) included in the target test pattern image (TPat) step S150). Specifically, the determination target patterns are detected from all linear patterns other than linear patterns included in position marks that have already been detected by previous runs of the position mark detection process. Note that at first execution of step S150, all linear patterns in the position mark detection pattern are undetected.

Next, for the three linear patterns selected as the determination target patterns, it is determined whether the interval between a middle linear pattern and a linear pattern at one end is equal to the interval between the middle linear pattern and a linear pattern at the other end (step S152). When the determination result is that the intervals are equal, the procedure advances to step S154. When the intervals are not equal, the procedure advances to step S158. Note that at step S152, whether the two intervals are equal is simply determined, but instead of this, it may be determined whether the two intervals are equal to each other and also to the predetermined interval D. This increases the amount of processing for position mark detection but can enhance position mark detection accuracy.

When the procedure advances to step S154, the three linear patterns selected as the determination target patterns are determined to constitute a position mark. This means that one position mark, including the three linear patterns, has been detected from the position detection pattern image (PPat). For example, assuming that the determination target patterns in the example shown in FIG. 9 are sequentially processed for each set of three linear patterns from a reference position Pref to the right in the figure, the closer of the two first position marks (PM1) to the reference position Pref is initially detected. Here, the reference position Pref refers to a predetermined end position in a target test pattern image with no missing end and a test pattern TPat being positioned within a clip-out area, i.e., the end position in the target test pattern image corresponds to the position of the first nozzle of the recording head 210.

Next, the type of the position mark detected at step S154 is determined on the basis of a linear pattern length of the position mark. For example, when the closer of the two position marks PM1 to the reference position Pref is detected, as described above, the linear pattern length of the position mark PM1 has a predetermined lowest value, and therefore, the position mark PM1 is determined to be the "first position mark PM1". Note that each linear pattern in each position mark corresponds to a predetermined nozzle, and therefore, by determining the type of the detected position mark, the nozzle that recorded the linear pattern in the position mark in the target test pattern image (TPat) can be identified. However, when the detected position mark is one of a pair of position marks, it has to be known whether the position mark is closer to the reference position Pref.

Next, at step S158, it is determined whether there is any undetected linear pattern remaining in the position detection pattern image (PPat). When the determination result is that there remains an undetected linear pattern, the procedure returns to step S150. Thereafter, steps S150 to S158 will be repeated until all linear patterns are detected from the position detection pattern image (PPat). The position mark detection process ends upon detection of all linear patterns.

Once the position mark detection process ends, the procedure returns to the ejection-failed nozzle detection process and advances to step S122 in FIG. 10. At step S122, it is determined whether two position marks including the shortest linear patterns (referred to below as "shortest position marks") are detected. This is equivalent to a determination as to whether the two first position marks PM1 in the example shown in FIG. 9 are detected.

Figure 12:
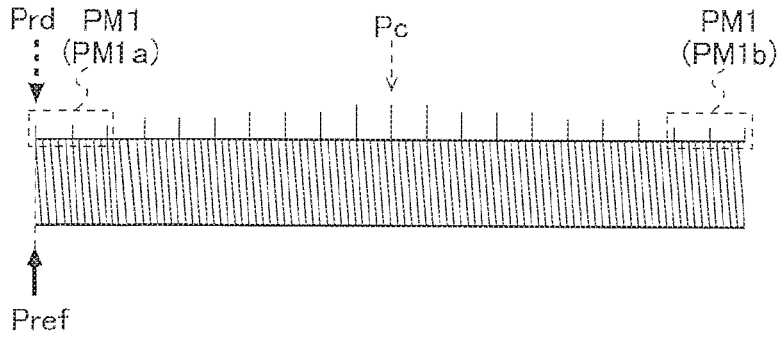
FIG. 12 is a diagram for describing a first example of a process for determining a reference position in a test pattern image in the embodiment.

When the determination result at step S122 is that two shortest position marks are detected, the procedure advances to step S124. Here, of the three linear patterns in the closer of the two shortest position marks to the reference position Pref in the target test pattern image, the farthest linear pattern from the center of the position detection pattern image is located at a position Prd, and at step S124, the position Prd of the farthest linear pattern is considered as the reference position Pref in the target test pattern image (see FIG. 12). Note that the first of the two shortest position marks detected by the position mark detection process at S120 (FIG. 11) is determined as the closer of the two shortest position marks to the reference position Pref. In the case where the target, test pattern image is a print of patterns as shown in FIG. 9, when position marks are detected sequentially from the left in the figure by the position mark detection process, of the three linear patterns in the first of two shortest position marks among the detected position marks (in FIG. 12, of the three linear patterns in a position mark PM1*a*, which is the first of two detected first position marks PM1), the farthest from the center Pc of the position detection pattern is located at the position Prd, and the position Prd is considered as the reference position Pref. Here, when a pair of position marks PMk (where k=1, 2, . . . ) are distinguished from each other, the closer of the two position marks PMk to the reference position Pref is denoted by the symbol "PMka", and the farther from the reference position Pref is denoted by the symbol "PMkb".

Figure 13:
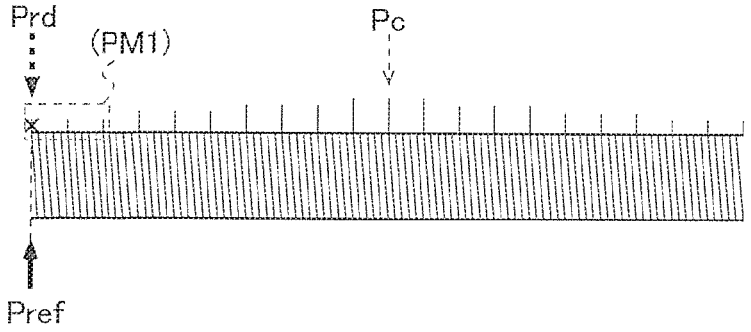
FIG. 13 is a diagram showing an example where a first position mark is not detectable from the test pattern image in the embodiment.

When the determination result at step S122 is that two shortest position marks are not detected (e.g., when only one shortest position mark is detected), the procedure advances to step S126, where it is determined whether a position mark at the center of the position detection pattern PPat is detected. Specifically, when the target test pattern image is a print of patterns as shown in FIG. 9 and one of the first position marks PM1 (or the shortest position marks) is not detected because the farthest linear pattern from the center Pc of the position detection pattern is missing (due to, for example, an ejection failure of a corresponding nozzle), as shown in FIG. 13, it is determined whether the fourth position mark PM4 (i.e., the position mark at the center, which will also be referred to simply as the "center position mark") is detected. Note that in FIG. 13, one linear pattern is denoted by the symbol "×" to indicate that the linear pattern is not printed, i.e., the linear pattern is missing (the same applies to FIGS. 14 to 19 to be referred to later).

Figure 14:
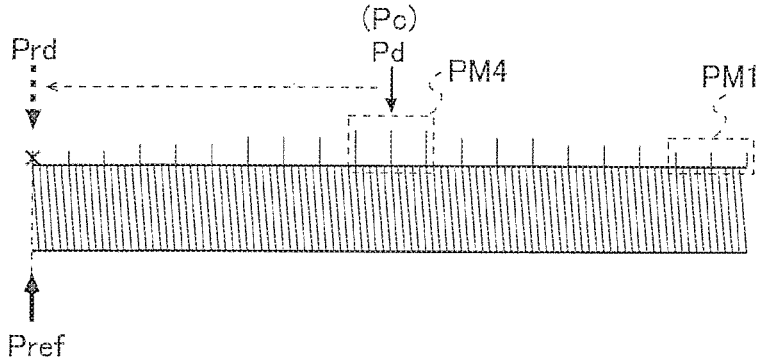
FIG. 14 is a diagram for describing a second example of the process for determining a reference position in the test pattern image in the embodiment.

When the determination result at step S126 is that the center position mark is detected, the procedure advances to step S128, where the reference position Pref is determined with reference to the center position mark. Specifically, since each linear pattern in the center position mark corresponds to a predetermined nozzle, the position Prd that corresponds to the reference positron Pref (the position Pref is a position in the target test pattern image that corresponds to the first nozzle) is determined based on identification information for a nozzle corresponding to any one linear pattern in the center position mark and the position of that linear pattern in the target test pattern image. For example, when the target test pattern image is a print of patterns as shown in FIG. 9 and the fourth position mark PM4 (i.e., the center position mark) is detected, as shown in FIG. 14, the position Prd that corresponds to the reference position Pref is determined based on the identification information for the nozzle that corresponds to the middle linear pattern in the fourth position mark PM4 and the position Pd of the middle linear pattern in the target test pattern image.

Figure 15:
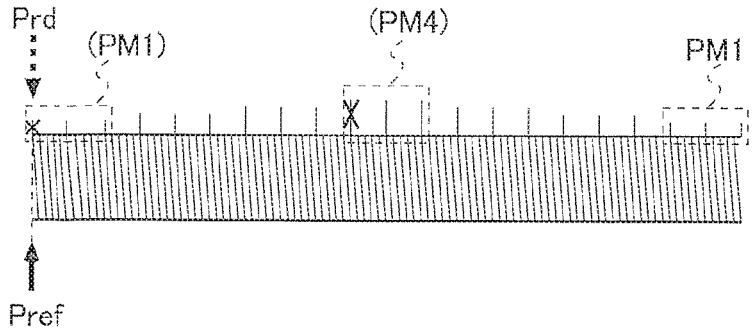
FIG. 15 is a diagram showing an example where neither a first nor a fourth position mark is detectable from the test pattern image in the embodiment.

When the determination result at step S126 is that the center position mark is not detected, the procedure advances to step S130, where it is determined whether two position marks of the same type, i.e., a pair of position marks, are detected from the position detection pattern PPat. When the target test pattern image is a print of patterns as shown in FIG. 9 and the fourth position mark PM4 (i.e., the center position mark) is not detected because one of the three linear patterns that constitute the fourth position mark PM4 is missing, as shown in FIG. 15, it is determined whether two position marks of the same type (e.g., a pair of second position marks PM2 or a pair of third position marks PM3) are detected.

When the determination result at step S130 is that a pair of position marks are detected, the procedure advances to step S132, where a reference position Pref in the target test pattern image (TPat) is determined based on one position mark in the detected pair. Specifically, once a pair of position marks are detected, it becomes possible to identify a corresponding nozzle for each linear pattern in the pair of position marks and also the position of the linear pattern in the target test pattern image. Accordingly, a position Prd that corresponds to the reference position Pref is determined on the basis of identification information for a nozzle corresponding to any one linear pattern in the pair and the position of that linear pattern in the target test pattern image. For example, when the target test pattern image is a print of patterns as shown in FIG. 9 and a pair of second position marks PM2 are detected, as shown in (A) of FIG. 16, the position Prd that corresponds to the reference position Pref is determined on the basis of identification information for a nozzle corresponding to any one linear pattern in a second position mark PM2*a*, which is the closer of the pair to the reference position Pref, as well as the position Pd of that linear pattern in the target test pattern image.

When the determination result at step S130 is that no pair of position marks are detected, the procedure advances to step S134, where it is determined whether two position marks different in linear pattern length, i.e., two position marks of different types, are detected. In the case where the target test pattern image is a print of patterns as shown in FIG. 9, when none of the fourth position mark PM4, i.e., the center position mark, the farther of the two third position marks PM3 from the reference position Pref, and the farther of the two second position marks PM2 from the reference position Pref is detected because one of three constituent linear patterns is missing in each of these position marks, as shown in (B) of FIG. 16, it is determined whether two position marks of different types (i.e., the second and third position marks PM2*a* and PM3*a* closer to the reference position Pref) are detected. Note that in general, even when three or more position marks of different types are detected, it is determined at step S134 that two position marks of different types are detected, and any two of the three or more position marks will be subjected to subsequent processing.

When the determination result at step S134 is that two position marks of different types are detected, the procedure advances to step S136, where a reference position Pref in the target test pattern image (TPat) is determined on the basis of one of the two position marks. Specifically, once two position marks of different types are detected, it becomes possible to identify a corresponding nozzle for each linear pattern in the two position marks and also the position of the linear pattern in the target test pattern image on the basis of the positional relationship between the two position marks. Accordingly, a position Prd that corresponds to the reference position Pref is determined on the basis of identification information for a nozzle corresponding to any one linear pattern in the two position marks and the position of that linear pattern in the target test pattern image. For example, when the target test pattern image is a print of patterns as shown in FIG. 9 and a second position mark PM2 and a third position mark PM3 are detected, as shown in (B) of FIG. 16, the second position mark PM2 is closer to the reference position Pref than is the third position mark PM3, and therefore, the second position mark PM2*a* can be identified (as the closer of the two position marks to the reference position Pref). Moreover, a position Prd that corresponds to the reference position Pref is determined on the basis of identification information for a nozzle corresponding to any one linear pattern in the second position mark PM2*a* as well as the position Pd of that linear pattern in the target test pattern image. Further, for example, when the target test pattern image is a print of patterns as shown in FIG. 9 and a second position mark PM2 and a third position mark PM3 are detected, as shown in (C) of FIG. 16, the second position mark PM2 is farther from the reference position Pref than is the third position mark PM3, and therefore, the second position mark PM2*b* can be identified (as the farther of the two position marks from the reference position Pref). Moreover, a position Prd that corresponds to the reference position Pref is determined on the basis of identification information for a nozzle corresponding to any one linear pattern in the second position mark PM2*b* as well as the position Pd of that linear pattern in the target test pattern image.

In such a manner as described above, the position Prd that corresponds to the reference position Pref is determined at step S124, S128, S132, or S136 and thereafter, the procedure advances to step S138. At step S138, an ejection-failed nozzle is identified on the basis of the position Prd (referred to below as the "detection reference position Prd") in the target test pattern image, which is obtained as described above, and the ejection failure detection result obtained at step S106 of the print defect detection process (FIG. 5), which specifies the position of a missing dot in the target test pattern image. After the identification of the ejection-failed nozzle, the ejection-failed nozzle detection process (FIG. 10) ends.

When the determination result at step S134 is that two position marks of different types are not detected, the procedure advances to step S140, where abnormal termination due to impossibility of position detection is notified. In the present embodiment, the abnormal termination notification is displayed in a manner predetermined by the control portion 100. Moreover, the control portion 100 may cause an alarm to be sounded to indicate abnormal termination in place of or along with the abnormal termination notification. After the abnormal termination notification, the ejection-failed nozzle detection process (FIG. 10) ends.

Figure 16:
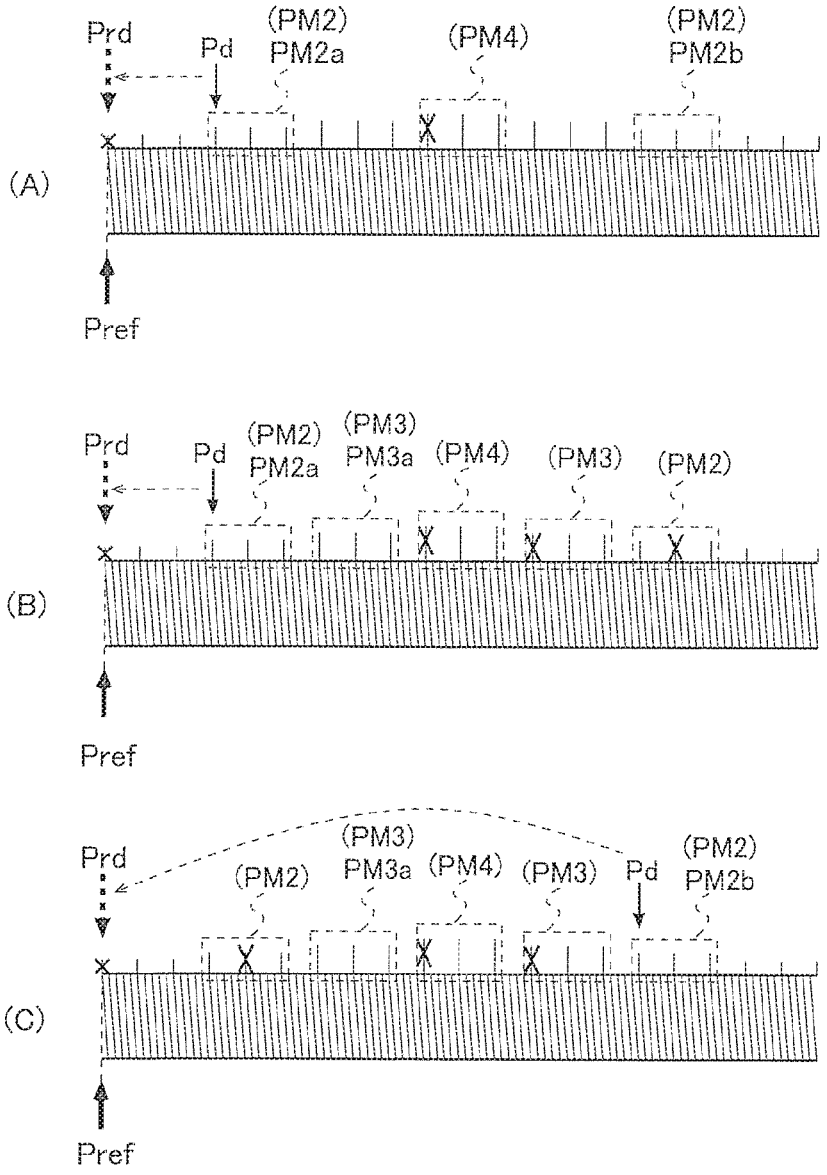
FIG. 16 consists of diagrams (A), (B), and (C) for respectively describing third, fourth, and fifth examples of the process for determining a reference position in the test pattern image in the embodiment.
Figure 17:
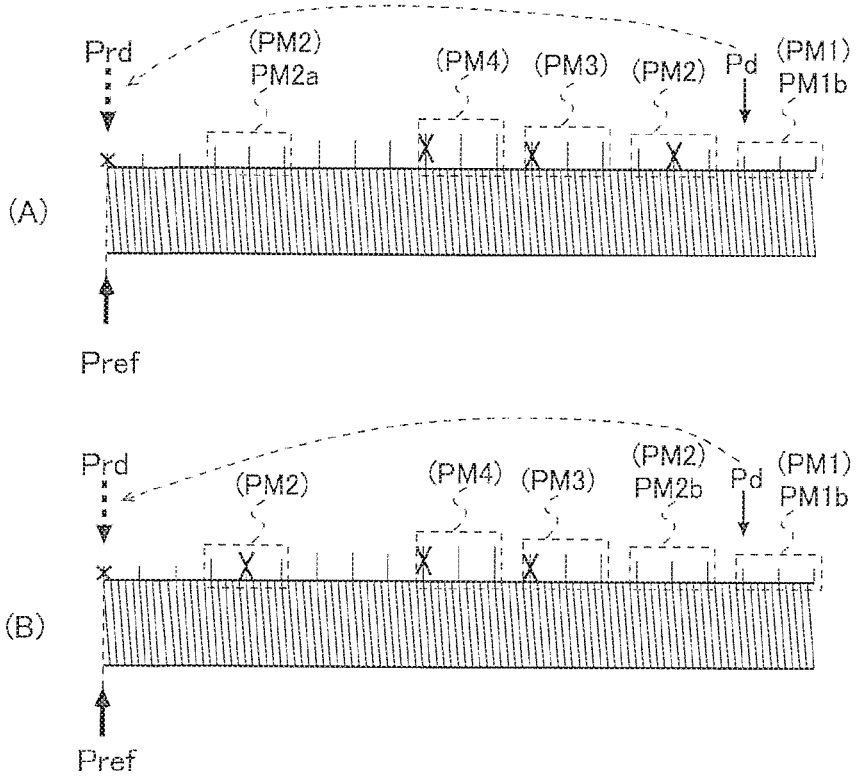
FIG. 17 consists of diagrams (A) and (B) for respectively describing sixth and seventh examples of the process for determining a reference position in the test pattern image in the embodiment.

It should be noted that when the target test pattern image is a print of patterns as shown in FIG. 9 and the determination result at step S134 is that two position marks of different types are detected, the reference position Pref in the target test pattern image is not necessarily determined as described in conjunction with (B) or (C) of FIG. 16. In the case where, for example, first and second position marks PM1 and PM2 are detected, as shown in (A) of FIG. 17, unlike in the case shown in (B) of FIG. 16, the first position mark PM1 is farther from the reference position Pref than is the second position mark PM2, and therefore, the first position mark PM1*b* is identified. Moreover, a position Prd that corresponds to the reference position Pref is determined on the basis of identification information for a nozzle corresponding to any one linear pattern in the first position mark PM1*b* as well as the position Pd of that linear pattern in the target test pattern image. Further, in the case where, for example, first and second position marks PM1 and PM2 are detected, as shown in (B) of FIG. 17, unlike in the case shown in (C) of FIG. 16, the first position mark PM1 is farther from the reference position Pref than is the second position mark PM2, and therefore, the first position mark PM1*b* is identified. Moreover, a position Prd that corresponds to the reference position Pref is determined on the basis of identification information for a nozzle corresponding to any one linear pattern in the first position mark PM1*b* as well as the position Pd of that linear pattern in the target test pattern image.

Upon completion of the ejection-failed nozzle detection process (FIG. 10), the procedure returns to the print defect detection process (FIG. 5) and advances to step S110.

By the ejection-failed nozzle detection process, the ejection-failed nozzle is identified from the target test pattern image (see step S138), and therefore, at step S110, information for identifying the ejection-failed nozzle is saved in the memory 112 as ejection failure position detection information for a recording head (referred to below as a "target recording head") 210 corresponding to the target test pattern image (see FIG. 2).

Once the ejection failure position detection information for the target recording head 210 is saved in the memory 112, as described above, the procedure advances to step S112, where it is determined whether there is any uninspected test pattern image remaining in the all-heads test pattern image (see FIG. 6). When the determination result is that there remains an uninspected test pattern image, the procedure returns to step S104. Thereafter, steps S104 to S112 will be repeated until ejection failure position detection information for all test pattern images in the all-heads test pattern image is generated and saved in the memory 112, and once the ejection failure position detection information for all test pattern images is saved in the memory 112, the print defect detection process ends.

As has already been described, in the present embodiment, when the print process in (A) of FIG. 4 is performed in normal mode, nozzle restoration is performed on a nozzle group including at least an ejection-failed nozzle identified by ejection failure position detection information stored in the memory 112 (step S14). When print process in (B) of FIG. 4 is performed, ejection failure correction is performed on print data on the basis of ejection failure position detection information (step S15).

6. Effects

In the present embodiment as described above, the test pattern TPat includes the position detection pattern PPat disposed positionally corresponding to the ejection failure detection pattern DPat in the sheet width direction, as shown in FIG. 8. The position detection pattern PPat includes a plurality of position marks PMk (where k=1 to 4), as shown in FIG. 9. Each position mark consists of three linear patterns arranged at equal intervals in the sheet width direction, and the interval between adjacent linear patterns is predetermined to be D. In the present embodiment, the position mark PMk is detected from the position detection pattern image within the target test pattern image on the basis of such characteristics of the interval between three linear patterns in each position mark, as shown in FIG. 11. Accordingly, even when dust or other foreign matter on the position detection pattern image within the target test pattern image appears to be a linear pattern that should not exist, the position mark PMk can be correctly detected by a simple process. More specifically, since each position mark PMk consists of three linear patterns, the position mark PMk can be reliably detected by a simpler process than the process for detecting a position mark or a reference mark employed by the inkjet printing device described in Japanese Laid-Open Patent Publication No. 2012-51135. In the present embodiment, an ejection-failed nozzle corresponding to a missing dot detected from an ejection failure detection pattern image (DPat) is identified on the basis of a position mark PMk thus detected (see FIG. 10).

Furthermore, as shown in FIG. 8, the three linear patterns in each position mark PMk have the same length, and the position detection pattern PPat includes a plurality of position marks having respective linear pattern groups, which differ in linear pattern length. Accordingly, even when a target test pattern image recorded on a sheet does not include an end of a test pattern (see (B) and (C) of FIG. 7), a position (detection reference position) Prd that corresponds to a reference position Pref can be determined on the basis of a position mark included in the target test pattern image, and an ejection-failed nozzle can be identified on the basis of the detection reference position Prd in the target test pattern image. Moreover, even when any one of the three linear patterns that are to be included in any position mark in the target test pattern image is missing due to, for example, a nozzle ejection failure, another position mark without a missing linear pattern can be detected, and such an ejection-failed nozzle can be identified on the basis of the detected position mark (see FIGS. 10 and 13 to 17). Thus, even when an end of a test pattern is not printed in inspection mode, or even when there are some missing linear patterns in position marks, a nozzle that caused a print defect, such as an ejection-failed nozzle or a nozzle that caused faulty gradation, can be identified.

As described above, in the present embodiment, even when an end of a test pattern is not recorded in inspection mode, even when there are some missing linear patterns in position marks, or even when dust appears to be on a linear pattern, position marks can be reliably detected by a simple process, and ejection failure position detection information can be generated for an ejection-failed nozzle identified on the basis of such a detected position mark. Such ejection failure position detection information is used for solving or compensating for a nozzle ejection failure (see (A) and (B) of FIG. 4).

Figure 18:
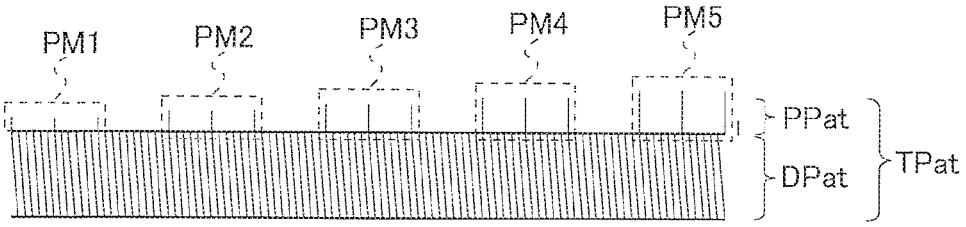
FIG. 18 is a diagram illustrating an example of a test pattern in a first variant of the embodiment.

It should be noted that in the present embodiment, the position detection pattern PPat within the test pattern TPat includes a center position mark (fourth position mark PM4) and a plurality of pairs of position marks (first to third position mark pairs PM1 to PM3) symmetrically arranged in the sheet width direction with respect to a middle linear pattern in the center position mark, as shown in FIG. 9. However, instead of this, a plurality of position marks (PM1 to PM5) of different types may be arranged in the sheet width direction, either in ascending or descending order of length, as shown in FIG. 18. Alternatively, such position marks of different types may be arranged in random order. However, the symmetrical position mark arrangement in the present embodiment is more advantageous than the arrangement in ascending or descending order of length, in that the number of types of position marks can be reduced without reducing the number of position marks. Note that a configuration using the test pattern shown in FIG. 18 will be described below as a variant of the present embodiment.

7. Variants 7.1 First Variant

Figure 19:
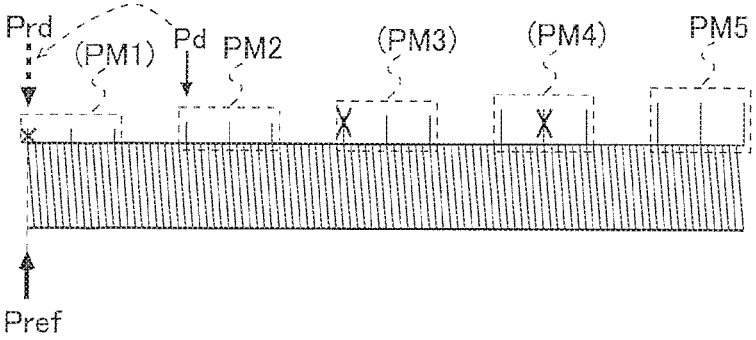
FIG. 19 is a diagram for describing an example of a process for determining a reference position in a test pattern image in the first variant of the embodiment.

FIG. 18 is a diagram illustrating an example of a test pattern in a first variant of the embodiment. In the test pattern shown in FIG. 18, first to fifth position marks PM1 to PM5 are arranged in the sheet width direction (i.e., from left to right in the figure) in ascending order of linear pattern group length. FIG. 19 is a diagram for describing an example of a process for determining a reference position in a test pattern image in the present variant. In each of the first, third, and fourth position marks PM1, PM3, and PM4 in the test pattern image shown in FIG. 19, one of three linear patterns is missing, and therefore, none of the first, third, and fourth position marks PM1, PM3, and PM4 can be detected by the position mark detection process in FIG. 11. However, the second and fifth position marks PM2 and PM5 are detected. Accordingly, in the present variant, a position Prd that corresponds to a reference position Pref is determined on the basis of identification information for a nozzle corresponding to any one of the three linear patterns in, for example, the second position mark PM2 and the position Pd of that linear pattern in a target test pattern image. Thus, the present variant, which uses the test pattern as shown in FIG. 18, also renders it possible to achieve effects similar to those achieved by the embodiment. Note that when all position marks in the position detection pattern PPat within the test pattern TPat are of different types, as in the present variant, the position marks do not have to be arranged in ascending or descending order of length. The reason for this is that in the present variant, each position mark in the target test pattern image can be uniquely identified by type (or linear pattern length).

7.2 Second Variant

Figure 20:
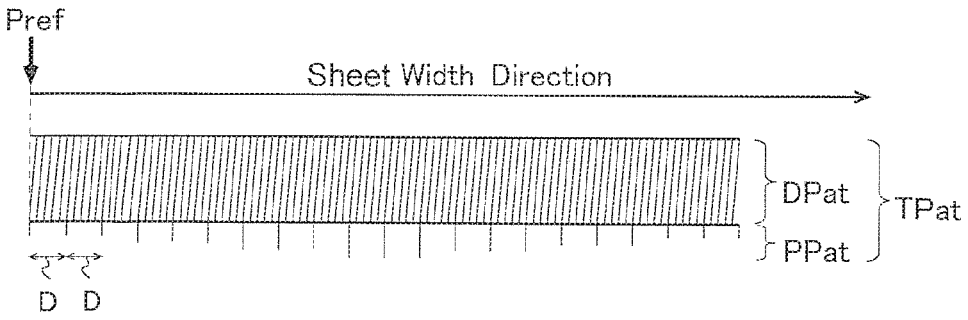
FIG. 20 is a diagram illustrating an example of a test pattern in a second variant of the embodiment.

FIG. 20 is a diagram illustrating an example of a test pattern in a second variant of the embodiment. In the test pattern TPat of the present variant, the position detection pattern PPat is disposed below the ejection failure detection pattern DPat, as shown in the figure, i.e., the positional relationship between the position detection pattern PPat and the ejection failure detection pattern DPat in the sheet feeding direction is opposite to that in the test pattern TPat of the embodiment (see FIG. 9). However, in the test pattern of the present variant, as in the test pattern of the embodiment, the position detection pattern PPat positionally corresponds to the ejection failure detection pattern DPat in the sheet width direction, position mark detection and ejection-failed nozzle identification based on a detected position mark can be performed in a similar manner to the embodiment (see FIGS. 10 and 11). Accordingly, the present variant, which uses the test pattern as shown in FIG. 20, also renders it possible to achieve effects similar to those achieved by the embodiment. More generally, similar effects can be achieved even with other test patterns, so long as the position marks in the position detection pattern PPat are configured in a similar manner to the embodiment, and the position detection pattern PPat and the ejection failure detection pattern DPat positionally correspond to each other in the sheet width direction.

7.3 Third Variant

Figure 21:
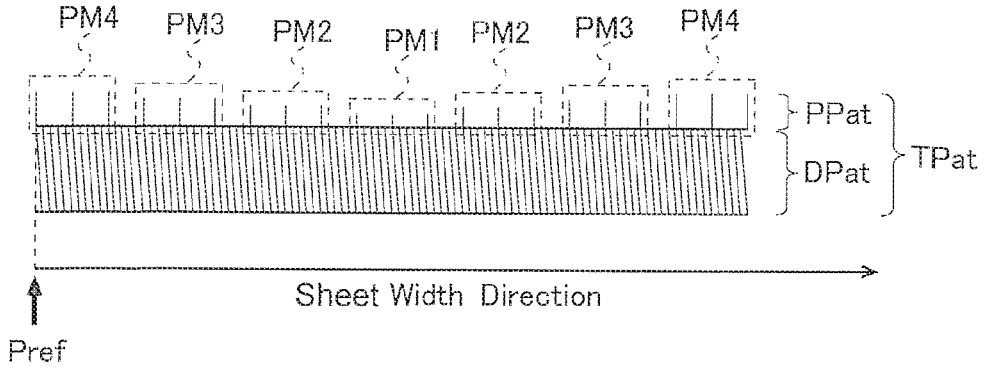
FIG. 21 is a diagram illustrating an example of a test pattern in a third variant of the embodiment.

FIG. 21 is a diagram illustrating an example of a test pattern in a third variant of the embodiment. The test pattern TPat of the present variant is similar to that of the embodiment (see FIG. 9) in that the position detection pattern PPat includes a center position mark and other position marks symmetrically arranged with respect to the center position mark in the sheet width direction, but the test pattern TPat of the present variant differs from that of the embodiment in that the center position mark (first position mark PM1) consists of a group of shortest linear patterns, and the other position marks (second to fourth position marks PM2 to PM4) are arranged in ascending order of linear pattern group length with increasing distance from the center position mark. However, the present variant also allows position mark detection and ejection-failed nozzle identification based on a detected position mark to be performed in a similar manner to the embodiment (see FIGS. 10 and 11), thereby achieving effects similar to those achieved by the embodiment.

7.4 Fourth Variant

Figure 22:
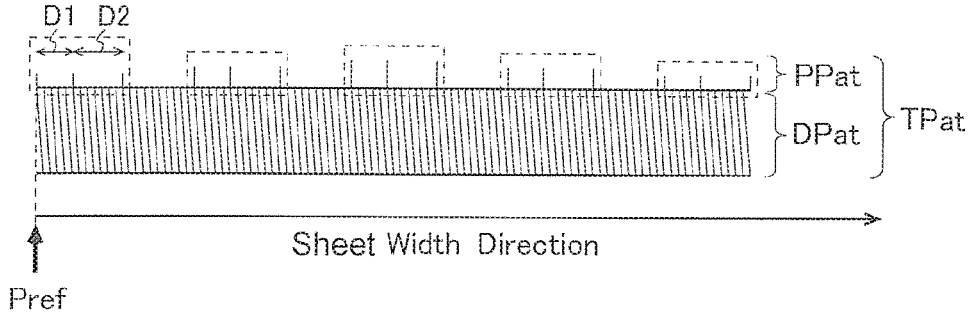
FIG. 22 is a diagram illustrating an example of a test pattern in a fourth variant of the embodiment.

In the embodiment and the variants described above, each position mark consists of three linear patterns having the same length and disposed at equal intervals (see FIGS. 9, 18, 20, and 21), but the three linear patterns do not have to be disposed at equal intervals, so long as the intervals between the three linear patterns are predetermined and known. FIG. 22 is a diagram illustrating an example of a test pattern in a fourth variant of the embodiment. In the present variant, each position mark consists of three linear patterns having the same length, namely, first to third linear patterns. The interval between the middle linear pattern, i.e., the second linear pattern, and the closer of the other two linear patterns to the reference position Pref, i.e., the first linear pattern, is predetermined to be D1. The interval between the second linear pattern and the farther of the other two linear patterns from the reference position Pref, i.e., the third linear pattern, is predetermined to be D2 ($D1 \neq D2$). Correspondingly, in the present variant, determination step S152 in the position mark detection process in FIG. 11 is changed to the step of determining "whether the interval between the middle of three linear patterns targeted for determination and the closer of the other two linear patterns to the reference position Pref is the predetermined interval D1, as well as whether the interval between the middle linear pattern and the farther of the other two linear patterns from the reference position Pref is the predetermined interval D2". The other steps in the print defect detection process in the present variant are the same as those in the embodiment (see FIGS. 5 and 10). The variant as above allows position mark detection and ejection-failed nozzle identification based on a detected position mark to be performed in a similar manner to the embodiment (see FIG. 10), thereby achieving effects similar to those achieved by the embodiment. Note that when the intervals between the linear patterns that constitute each position mark are predetermined, the position mark may also be constituted by two or four or more linear patterns, instead of three linear patterns.

7.5 Fifth Variant

Figure 23:
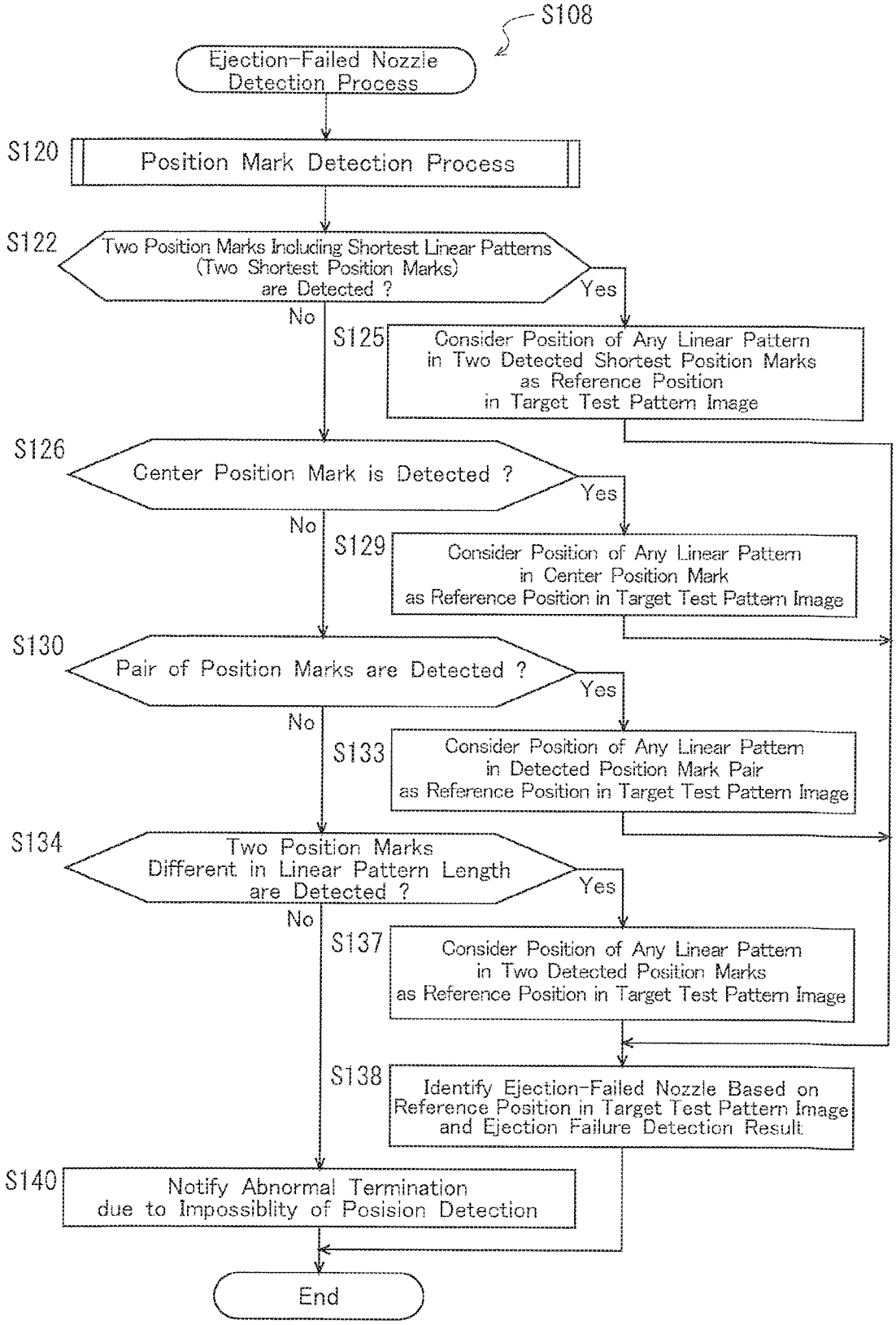
FIG. 23 is a flowchart showing an ejection-failed nozzle detection process in a fifth variant of the embodiment.

Next, a fifth variant of the embodiment will be described. In the embodiment, a predetermined end position in a target test pattern image (the position corresponding to the first nozzle of the recording head 210) is set as a reference position Pref (FIG. 9), position marks are detected from the target test pattern image (TPat), a position (detection reference position) Prd that corresponds to the reference position is determined (see FIGS. 11 and 12 to 17), and an ejection-failed nozzle is identified based on the detection reference position Prd and an ejection failure detection result (i.e., information indicating the position of a missing dot in the target test pattern image; see FIG. 10). On the other hand, in the present variant, the position of any one linear pattern in a position mark detected from the target test pattern image is set as the reference position, and the ejection-failed nozzle is identified on the basis of the reference position and the ejection failure detection result. More specifically, in the present variant, the ejection-failed nozzle is identified by the CPU 111 in the control portion 100 executing an ejection-failed nozzle detection process shown in FIG. 23, instead of the ejection-failed nozzle detection process shown in FIG. 10. The ejection-failed nozzle detection process in FIG. 23 includes steps S125, S129, S133, and S137, in place of steps S124, S128, S132, and S136 of the ejection-failed nozzle detection process in FIG. 10. Accordingly, in the present variant, when two shortest position marks are detected at step S122, the position of any one linear pattern in the two shortest position marks is considered as the reference position (step S125). Moreover, when a center position mark is detected at step S126, the position of any one linear pattern in the center position mark is considered as the reference position (step S129). Further, when a pair of position marks are detected at step S130, the position of any one linear pattern in the detected pair is considered as the reference position (step S133). Still further, when two position marks having different linear pattern lengths are detected at step S134, the position of any one linear pattern in the two detected position marks is considered as the reference position (step S137). The present variant as above also renders it possible to achieve effects similar to those achieved by the embodiment.

7.6 Other Variants

In the embodiment and the variants described above, each linear pattern included in the position mark in the target test pattern image is a pattern having a width of one dot printed simply by any one nozzle, but instead of this, the pattern may have a width of a plurality of dots printed by a plurality of adjacent nozzles (for example, two or three adjacent nozzles). Effects similar to those achieved by the embodiment can be achieved even by using such linear patterns. so long as each linear pattern corresponds in advance to nozzles to be used for printing the linear pattern.

Furthermore, in the embodiment, the recording portion 205 includes n recording heads 210 arranged across the width of the sheet 5 (see FIG. 3), but this is not limiting, and the recording portion 205 may include, for example, only one recording head 210 disposed in the sheet width direction. The present invention can also be applied to an inkjet device including such a recording portion 205.

Furthermore, in the embodiment, the test pattern TPat is constituted by the ejection failure detection pattern DPat and the position detection pattern PPat. However, the test pattern TPat may be constituted by the position detection pattern PPat and a print defect detection pattern different from the ejection failure detection pattern DPat, e.g., a density insufficiency detection pattern. An example of the density insufficiency detection pattern is a pattern obtained by printing a solid image with uniform density on a sheet 5 by means of the nozzles 21 of the recording head 210. A print-defective portion with non-uniform density is detected from the density insufficiency detection pattern, and a defective nozzle 21 used for printing the defective portion is identified based on the position detection pattern PPat. In addition, image data for the nozzle 21 is corrected (by means of shading compensation), thereby making the density of the printed image uniform. The present invention can also be applied with a view to identifying the position of a nozzle used for printing a defective portion in such a density insufficiency detection pattern.

While the invention has been described in detail, the foregoing description is in all aspects illustrative and not restrictive. It is understood that numerous other modifications and variations can be devised without departing from the scope of the invention.

8. Appendix

As is apparent from the foregoing, the present invention encompasses at least the following first through twelfth embodiments.

The first embodiment of the present invention provides an inkjet printing device having an inspection mode in which to detect a print defect, the device including:

a recording head configured to eject ink onto a recording medium;

a feeding mechanism configured to move the recording medium in a predetermined feeding direction relative to the recording head;

a control portion configured to control the recording head and the feeding mechanism to record an image on the recording medium; and an imaging portion configured to capture an image recorded on the recording medium, wherein, the recording head includes a plurality of nozzles arranged in a direction perpendicular to the feeding direction, the control portion in the inspection mode controls the recording head and the feeding mechanism to record a test pattern image on the recording medium, the test pattern image including a print defect detection pattern for detecting a print defect in an image to be recorded on the recording medium by the recording head and a position detection pattern for detecting a position of the print defect detected based on the print defect detection pattern, the control portion in the inspection mode causes the imaging portion to capture the test pattern image recorded on the recording medium and thereby obtain a target test pattern image, the control portion in the inspection mode detects a print defect from the target test pattern image and identifies a defective nozzle based on the detected print defect, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles, and when the test pattern image is recorded on the recording medium, an image of each linear pattern in the position detection pattern is recorded with ink ejected from a nozzle corresponding to the linear pattern.

In the first embodiment of the invention, the test pattern image including the print defect detection pattern and the position detection pattern is recorded on the recording medium in the inspection mode, and the target test pattern image is obtained by capturing one test pattern image. A print detect is detected from the target test pattern image, and a defective nozzle is identified on the basis of the detected print defect. The position detection pattern in the test pattern includes a plurality of position marks each consisting of a predetermined number (two or more) of linear patterns that have the same length, extend in the recording medium feeding direction, and are disposed at predetermined intervals. Accordingly, even when dust or other foreign matter on the target test pattern image appears to be a linear pattern that should not exist, position marks can be correctly detected. Moreover, one of the position marks differs in linear pattern croup length from another position mark, and each linear pattern in the position marks corresponds to a specific one of the nozzles included in the recording head. Accordingly, even when an end of a test pattern is not printed in the inspection mode, or even when there are some missing linear patterns in the position marks, either the position mark that has a different linear pattern group length or another position mark is detected, and on the basis of the linear pattern length of the detected position mark, the detected position mark is identified, so that a position to be referenced in the target test pattern image (a reference position) can be decided. Thus, even when an end of a test pattern is not printed in inspection mode, even when there are some missing linear patterns in position marks, or even when there is some dust or other matter that appears to be a linear pattern, some position mark can be reliably detected by a simple process, and on the basis of the detected position mark, a defective nozzle can be identified.

The second embodiment of the present invention provides the inkjet printing device according to the first embodiment, wherein each linear pattern in the position marks corresponds to any one of the nozzles.

In the second embodiment of the invention, each linear pattern in each position mark included in the position detection pattern corresponds to any one of the nozzles included in the recording head. Thus, a reference position in the target test pattern image can be determined on the basis of any one linear pattern in a position mark detected in the inspection mode, and a defective nozzle can be identified on the basis of the reference position and a print defect detection result.

The third embodiment of the present invention provides the inkjet printing device according to the first embodiment, wherein the control portion detects a predetermined number of adjacent linear patterns having an equal length from an image of the position detection pattern within the target test pattern image, determines whether the predetermined number of adjacent linear patterns are arranged at the predetermined intervals, the predetermined number being two or more, and considers that the predetermined number of adjacent linear patterns constitute one position mark when determined to be arranged at the predetermined intervals and that the predetermined number of adjacent linear patterns do not constitute any position mark when not determined to be arranged at the predetermined intervals.

In the third embodiment of the invention, when a predetermined number (two or more) of adjacent linear patterns having the same length are detected from the position detection pattern image in the target test pattern image and these linear patterns are determined to be disposed at predetermined intervals, the linear patterns are considered to constitute a position mark. In this manner, the position mark for use in determining a reference position in the target test pattern image can be accurately detected by a simple process.

The fourth embodiment of the present invention provides the inkjet printing device according to the first embodiment, wherein the control portion detects three adjacent linear patterns having an equal length from an image of the position detection pattern within the target test pattern image, determines whether the three adjacent linear patterns are disposed at equal intervals, and considers that the three adjacent linear patterns constitute one position mark when determined to be disposed at equal intervals and that three adjacent linear patterns do not constitute any position mark when not determined to be disposed at equal intervals.

In the fourth embodiment of the invention, when three adjacent linear patterns having the same length are detected from the position detection pattern image within the target test pattern image and these linear patterns are determined to be disposed at equal intervals, the linear patterns are considered to constitute a position mark. In this manner, the position mark for use in determining a reference position in the target test pattern image can be accurately detected by a simple process.

The fifth embodiment of the present invention provides the inkjet printing device according to the first embodiment, wherein the position detection pattern includes one or more position mark pairs, each consisting of two position marks constituted by linear pattern groups having an equal length, and also includes one position mark consisting of a linear pattern group having a different length from any linear pattern group in the one or more position mark pairs, and in the position detection pattern, each position mark pair differs in linear pattern group length from another position mark pair, and the one or more position mark pairs are arranged symmetrically with respect to the one position mark in a direction perpendicular to the feeding direction.

In the fifth embodiment of the invention, it is possible to reduce the number of types of position marks (the types being classified by linear pattern length) without reducing the number of position marks, whereby it is rendered possible to more accurately detect and distinguish the position mark for use in determining a reference position in the target test pattern image.

The sixth embodiment of the present invention provides the inkjet printing device according to the fifth embodiment, wherein the position detection pattern is configured such that the one or more position mark pairs decrease or increase in linear pattern group length with increasing distance from a center of the position detection pattern.

In the sixth embodiment of the invention, even when the number of undetectable position marks increases due to the lack of linear patterns, it is possible to detect and distinguish some other position mark.

The seventh embodiment of the present invention provides the inkjet printing device according to the fifth embodiment, wherein the position detection pattern is configured such that a linear pattern farthest from a center of the position detection pattern is located at an end position in the test, pattern.

In the seventh embodiment of the invention, by detecting the position mark that includes the farthest linear pattern from the center of the position detection pattern, a reference position in the target test pattern image can be determined more readily.

The eighth embodiment of the present invention provides the inkjet printing device according to any one of the first through fifth embodiments, wherein the control portion detects at least one position mark from the position detection pattern within the target test pattern image, and identifies a defective nozzle based on the detected position mark and the print defect detected from the target test pattern image.

In the eighth embodiment of the invention, at least one position mark is detected from the position detection pattern within the target test pattern image, and a defective nozzle is identified on the basis of the detected position mark and the print defect detected from the target test pattern image, whereby effects similar to those achieved by the first through fifth embodiments of the invention can be achieved.

The ninth embodiment of the present invention provides the inkjet printing device according to the eighth embodiment, wherein the control portion determines an end position in the target test pattern image based on the detected position mark, and identifies a defective nozzle based on the end position and the print defect detected from the target test pattern image.

In the ninth embodiment of the invention, an end position in the target test pattern image is determined as a reference position on the basis of a detected position mark, and a defective nozzle is identified on the basis of the end position and the print defect detection result, whereby effects similar to those achieved by the first through fifth embodiments of the invention can be achieved.

The tenth embodiment of the present invention provides the inkjet printing device according to the eighth embodiment, wherein the control portion drives the recording head such that nozzle restoration is performed so as to restore the identified defective nozzle from an ejection failure.

The tenth embodiment of the invention renders it possible to, even when recording quality deteriorates due to a nozzle ejection failure, achieve recording quality restoration by maintenance such as flushing of a nozzle with the ejection failure.

The eleventh embodiment of the present invention provides the inkjet printing device according to the eighth embodiment, wherein the control portion corrects print data for driving the recording head, such that a missing dot in the image to be recorded on the recording medium due to the defective nozzle is compensated for.

In the eleventh embodiment of the invention, print data for driving the recording head is corrected such that a missing dot in an image to be recorded on the recording medium due to a nozzle with an ejection failure is compensated for, and therefore, it is possible to alleviate recording quality deterioration due to a nozzle ejection failure.

The twelfth embodiment of the present invention provides a print defect detection method for detecting a print defect in forming an image on a recording medium by an inkjet printing device ejecting ink onto the recording medium through a plurality of nozzles arranged in a recording head in a direction perpendicular to a predetermined feeding direction while moving the recording medium in the feeding direction relative to the recording head, the method including:

an image formation step of recording a test pattern image on the recording medium, the test pattern image including a print defect detection pattern for detecting a print defect in an image to be recorded on the recording medium by the recording head and a position detection pattern for detecting a position of the print defect detected based on the print defect detection pattern;

an imaging step of obtaining a target test pattern image by capturing the test pattern image recorded on the recording medium by the image formation step; and a defect detection step of detecting a print defect from the target test pattern image and identifies a defective nozzle based on the detected print defect, wherein, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles, and when the test pattern image is recorded on the recording medium, an image of each linear pattern in the position detection pattern is recorded with ink ejected from a nozzle corresponding to the linear pattern.

What is claimed is:

1. An inkjet printing device having an inspection mode in which to detect a print defect, comprising:

a recording head configured to eject ink onto a recording medium;

a feeding mechanism configured to move the recording medium in a predetermined feeding direction relative to the recording head;

a control portion configured to control the recording head and the feeding mechanism to record an image on the recording medium; and an imaging portion configured to capture the image recorded on the recording medium, wherein, the recording head includes a plurality of nozzles arranged in a direction perpendicular to the feeding direction, the control portion in the inspection mode controls the recording head and the feeding mechanism to record a test pattern image on the recording medium, the test pattern image including a print defect detection pattern for detecting the print defect in the image to be recorded on the recording medium by the recording head and a position detection pattern for detecting a position of the print defect detected based on the print defect detection pattern, the control portion in the inspection mode causes the imaging portion to capture the test pattern image recorded on the recording medium and thereby obtain a target test pattern image, the control portion in the inspection mode detects a print defect from the target test pattern image and identifies a defective nozzle based on the detected print defect, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles, and when the test pattern image is recorded on the recording medium, an image of each linear pattern in the position detection pattern is recorded with ink ejected from a nozzle corresponding to the linear pattern.

2. The inkjet printing device according to claim 1, wherein each linear pattern in the position marks corresponds to any one of the nozzles.

3. The inkjet printing device according to claim 1, wherein the control portion detects a predetermined number of adjacent linear patterns having an equal length from an image of the position detection pattern within the target test pattern image, determines whether the predetermined number of adjacent linear patterns are arranged at the predetermined intervals, the predetermined number being two or more, and considers that the predetermined number of adjacent linear patterns constitute one position mark when determined to be arranged at the predetermined intervals and that the predetermined number of adjacent linear patterns do not constitute any position mark when not determined to be arranged at the predetermined intervals.

4. The inkjet printing device according to claim 1, wherein the control portion detects three adjacent linear patterns having an equal length from an image of the position detection pattern within the target test pattern image, determines whether the three adjacent linear patterns are disposed at equal intervals, and considers that the three adjacent linear patterns constitute one position mark when determined to be disposed at equal intervals and that the three adjacent linear patterns do not constitute any position mark when not determined to be disposed at equal intervals.

5. The inkjet printing device according to claim 1, wherein, the position detection pattern includes one or more position mark pairs, each consisting of two position marks constituted by linear pattern groups having an equal length, and also includes one position mark consisting of a linear pattern group having a different length from any linear pattern group in the one or more position mark pairs, and in the position detection pattern, each position mark pair differs in linear pattern group length from another position mark pair, and the one or more position mark pairs are arranged symmetrically with respect to the one position mark in a direction perpendicular to the feeding direction.

6. The inkjet printing device according to claim 5, wherein the position detection pattern is configured such that the one or more position mark pairs decrease or increase in linear pattern group length with increasing distance from a center of the position detection pattern.

7. The inkjet printing device according to claim 5, wherein the position detection pattern is configured such that a linear pattern farthest from a center of the position detection pattern is located at an end position in the test pattern.

8. The inkjet printing device according to claim 1, wherein the control portion detects at least one position mark from the position detection pattern within the target test pattern image, and identifies a defective nozzle based on the detected position mark and the print defect detected from the target test pattern image.

9. The inkjet printing device according to claim 8, wherein the control portion determines an end position in the target test pattern image based on the detected position mark, and identifies a defective nozzle based on the end position and the print defect detected from the target test pattern image.

10. The inkjet printing device according to claim 8, wherein the control portion drives the recording head such that nozzle restoration is performed so as to restore the identified defective nozzle from an ejection failure.

11. The inkjet printing device according to claim 8, wherein the control portion corrects print data for driving the recording head, such that a missing dot in the image to be recorded on the recording medium due to the defective nozzle is compensated for.

12. A print defect detection method for detecting a print defect in forming an image on a recording medium by an inkjet printing device ejecting ink onto the recording medium through a plurality of nozzles arranged in a recording head in a direction perpendicular to a predetermined feeding direction while moving the recording medium in the feeding direction relative to the recording head, the method comprising:

an image formation step of recording a test pattern image on the recording medium, the test pattern image including a print defect detection pattern for detecting a print defect in an image to be recorded on the recording medium by the recording head and a position detection pattern for detecting a position of the print defect detected based on the print defect detection pattern;

an imaging step of obtaining a target test pattern image by capturing the test pattern image recorded on the recording medium by the image formation step; and a defect detection step of detecting a print defect from the target test pattern image and identifies a defective nozzle based on the detected print defect, wherein, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles, and when the test pattern image is recorded on the recording medium, an image of each linear pattern in the position detection pattern is recorded with ink ejected from a nozzle corresponding to the linear pattern.

13. The print defect detection method according to claim 12, wherein the defect detection step includes a position mark detection step of detecting three adjacent linear patterns having an equal length from the position detection pattern image within the target test pattern image, determining whether the three adjacent linear patterns are disposed at equal intervals, and considering that the three adjacent linear patterns constitute one position mark when determined to be disposed at equal intervals and that the three adjacent linear patterns do not constitute any position mark when not determined to be disposed at equal intervals.

14. The print defect detection method according to claim 12, wherein, the position detection pattern includes one or more position mark pairs, each consisting of two position marks constituted by linear pattern groups having an equal length, and also includes one position mark consisting of a linear pattern group having a different length from any linear pattern group in the one or more position mark pairs, and in the position detection pattern, each position mark pair differs in linear pattern group length from another position mark pair, and the one or more position mark pairs are arranged symmetrically with respect to the one position mark in a direction perpendicular to the feeding direction.

15. A test pattern recorded on a recording medium for detecting a print defect in forming an image on the recording medium by an inkjet printing device ejecting ink onto the recording medium through a plurality of nozzles arranged in a recording head in a direction perpendicular to a predetermined feeding direction while moving the recording medium in the feeding direction relative to the recording head, the pattern comprising:

a print defect detection pattern for detecting a print defect in an image to be recorded on the recording medium by the recording head; and a position detection pattern for detecting a position of the print defect detected based on the print defect detection pattern, wherein, the position detection pattern includes a plurality of position marks, each consisting of a predetermined number of linear patterns that have an equal length, extend in the feeding direction, and are disposed at predetermined intervals, the predetermined number being two or more, one of the position marks having a different linear pattern group length from another position mark, each linear pattern in the position marks corresponding to a specific one of the nozzles.

16. The test pattern according to claim 15, wherein each position mark in the position detection pattern includes three linear patterns having an equal length and disposed at equal intervals.

17. The test pattern according to claim 15, wherein, the position detection pattern includes one or more position mark pairs, each consisting of two position marks constituted by linear pattern groups having an equal length, and also includes one position mark consisting of a linear pattern group having a different length from any linear pattern group in the one or more position mark pairs, and in the position detection pattern, each position mark pair differs in linear pattern group length from another position mark pair, and the one or more position mark pairs are arranged symmetrically with respect to the one position mark in a direction perpendicular to the feeding direction.

* * * * *